US006532347B2

(12) United States Patent
Watanabe et al.

(10) Patent No.: US 6,532,347 B2
(45) Date of Patent: Mar. 11, 2003

(54) METHOD OF CONTROLLING AN AC VOLTAGE APPLIED TO AN ELECTRIFIER

(75) Inventors: Yasunari Watanabe, Shizuoka-ken (JP); Motoki Adachi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/761,720

(22) Filed: Jan. 18, 2001

(65) Prior Publication Data

US 2001/0019669 A1 Sep. 6, 2001

(30) Foreign Application Priority Data

| | | |
|---|---|---|
| Jan. 20, 2000 | (JP) | 2000-011817 |
| Jan. 20, 2000 | (JP) | 2000-011818 |
| Jan. 20, 2000 | (JP) | 2000-011819 |
| Jan. 20, 2000 | (JP) | 2000-011820 |

(51) Int. Cl.[7] ..... G03G 15/02
(52) U.S. Cl. ..... 399/50; 361/225

(58) Field of Search ..... 399/50, 168, 170, 399/174–6; 361/225

(56) References Cited

U.S. PATENT DOCUMENTS

| | | | | |
|---|---|---|---|---|
| 4,851,960 A | | 7/1989 | Nakamura et al. | 361/225 |
| 5,642,254 A | * | 6/1997 | Benwood et al. | 361/225 |

FOREIGN PATENT DOCUMENTS

| | | | |
|---|---|---|---|
| JP | 63-149668 | | 6/1988 |
| JP | 4-66973 | * | 3/1992 |
| JP | 8-211786 | * | 8/1996 |
| JP | 2001209919 | * | 7/2001 |

* cited by examiner

*Primary Examiner*—Quana M. Grainger
(74) *Attorney, Agent, or Firm*—Fitzpatrick, Cella, Harper & Scinto

(57) ABSTRACT

A control method of a voltage to be applied to an electrifier includes the steps of measuring an integral value of an alternating waveform, and controlling an alternating current so that the integral value is constant in a predetermined time.

21 Claims, 22 Drawing Sheets

METHOD OF CONTROLLING AN AC VOLTAGE APPLIED TO AN ELECTRIFIER

BACKGROUND OF THE INVENTION

1. Field of the Invention

The present invention relates to a method for controlling an AC voltage to be applied to an electrifier used in an electrophotography type image forming apparatus to electrify a photosensitive body.

2. Related Backgrond Art

A convential method used to electrify a surface of an image bearing body such as, for example, a photosensitive body, a dielectric body or the like in an image forming apparatus such as, for example, an electrophotographic apparatus, an electrostatic recording apparatus or the like, is to perform corona electrification. Corona electrification electrifies a surface of the image bearing body without making contact by allowing a corona produced by applying a high voltage to a thin corona discharging wire to act on the surface of the image bearing body.

Increasingly, so as to use lower voltages, produce smaller levels of ozone, and to lower cost, a main current is being applied by a contact electrification method which electrifies a surface of an image bearing body by bringing a roller type, a blade type or a similar type of electrifying member into contact with the image bearing body and-applying a voltage to the electrifying member. In particular, the roller type electrifying member is capable of electrifying the surface of the image bearing body stably for a long time.

Though only a DC voltage may be applied to the electrifying member, this member can be uniformly electrified by applying an oscillating voltage so as to alternately cause discharge on a positive side and a negative side.

It is known that to average the electrification and uniformly electrify a body to be electrified one may, for example, apply an oscillating voltage which consists of an AC voltage having a peak to peak voltage not lower than twice a threshold value of a discharge start voltage (electrification start voltage) of a body to be electrified at a time of DC voltage application and a DC voltage (DC offset bias voltage) overlapped with the AC voltage.

A waveform of the oscillating voltage is not limited to a sine wave and may be a rectangular waveform, a triangular waveform of a pulse waveform. The oscillating voltage includes a voltage having the rectangular waveform which is shaped by periodically turning on and off a DC voltage, and a DC voltage whose value is periodically changed so as to have an output identical to that of an overlapped voltage consisting of an AC voltage and a DC voltage.

As described above, a contact electrification method which electrifies an electrifying member by applying an oscillating voltage to the electrifying member will hereinafter be referred to as "an AC electrification method". Furthermore, a contact electrification method which electrifies an electrifying member by applying only a DC voltage will hereinafter be referred to as "a DC electrification method".

However, the AC electrification method allows a larger amount of electric charges to be discharged to an image bearing body than the DC electrification method, accelerates deterioration such as cutting of the image bearing body and may produce abnormal images such as a flowed (smeared) image in an environment where a temperature and a humidity are enhanced by discharge products.

In order to solve this problem, it is necessary to minimize the discharge which is caused alternately on the positive side and the negative side by applying a minimum required voltage.

However, a relation between a voltage and an amount of discharged electric charges is not always constant, but changes dependently on thicknesses of photosensitive layers and dielectric layers of image bearing bodies, environmental changes of electrifying members and air, etc. In an environment where a temperature and a humidity are low (L/L), materials are dry and resistance values are enhanced, whereby discharge is liable to hardly occur and a peak to peak voltage higher than a definite value is necessary to obtain uniform electrification, but when an electrifying operation is performed in an environment where a temperature and a humidity are high (H/H), materials absorb moisture and resistance values are lowered even at a lowest voltage value which allows uniform electrification in the L/L environment, whereby an electrifying member discharges electric charge in an amount larger than required. As a result, the electric charges which are discharged in such a large amount pose problems of image flow, production of blur, toner fusion, cutting of a toner bearing body due to deterioration of a surface of the image bearing body, shortening of a service life and so on.

In order to supress increases and decreases of discharged electric charges due to environment variations, there has been proposed "an AC constant current control method" which controls a value of a supplied AC current by applying an AC voltage to an electrifying member in addition to "an AC constant voltage control method" which always applies a constant AC voltage as described above. The AC constant current control method is capable of enhancing a peak to peak voltage value of an AC voltage in the L/L environment where resistance of materials is enhanced and lowering a peak to peak voltage value in the H/H environment where the resistance of the materials is lowered, thereby making it possible to supress the increases and decreases of the amount of discharged electric charges more effectively than the AC constant voltage control method.

An electrifying member may not always be in contact with a surface of an image bearing body but may instead be disposed proximate to the electrifying member with a void (gap), for example, of several tens of micrometers reserved (proximity disposition) as a discharge enabling area. The discharge enabling area is determined by a gap to gap voltage and a correction Paschen curve is securely maintained between the electrifying member and the image bearing body, and this proximity disposition is included within a range of the contact electrification in the present invention.

For further prolonging a service life of an image bearing body, however, even the AC constant current control method is not perfect in suppressing the increase and decrease of the amount of discharged electric charges which are caused by changes of resistance values due to manufacturing dispersion and contamination of an electrifying member, variations of an electrostatic capacity of an image bearing body after long use, dispersion of a high-voltage apparatus of an image forming apparatus main unit and so on. In order to suppress the increase and decrease of the amount of discharged electric charges, it is necessary to use devices for suppressing manufacturing dispersion of the electrifying member, environmental changes and deflections of a high voltage, thereby enhancing a manufacturing cost.

SUMMARY OF THE INVENTION

An object of the present invention is to provide an application voltage control method which is capable of allowing an electrifier to discharge electric charges in a constant amount.

Another object of the present invention is to provide an application voltage control method which prevents excessive electric charges from being discharged.

Still another object of the present invention is to provide a method to control a voltage to be applied to an electrifier comprising the steps of:

measuring an integral value of an AC current waveform; and controlling an AC voltage so as to make the integral value constant in a predetermined time.

Further another object of the present invention is to provide a method to control a voltage to be applied to an electrifier comprising the steps of:

measuring an integral value of an AC current waveform:

detecting a peak value of the AC current waveform;

calculating an area of the AC current waveform from the detected peak value; and controlling an AC voltage so as to obtain a definite difference between the integral value and the area.

Further objects of the present invention will become apparent from the following description

DESCRIPTION OF THE PREFERRED EMBODIMENTS

Now, embodiments of the present invention will be described with reference to the accompanying drawings.

<First embodiment> (FIGS. 1 through 7)

Figure 1:
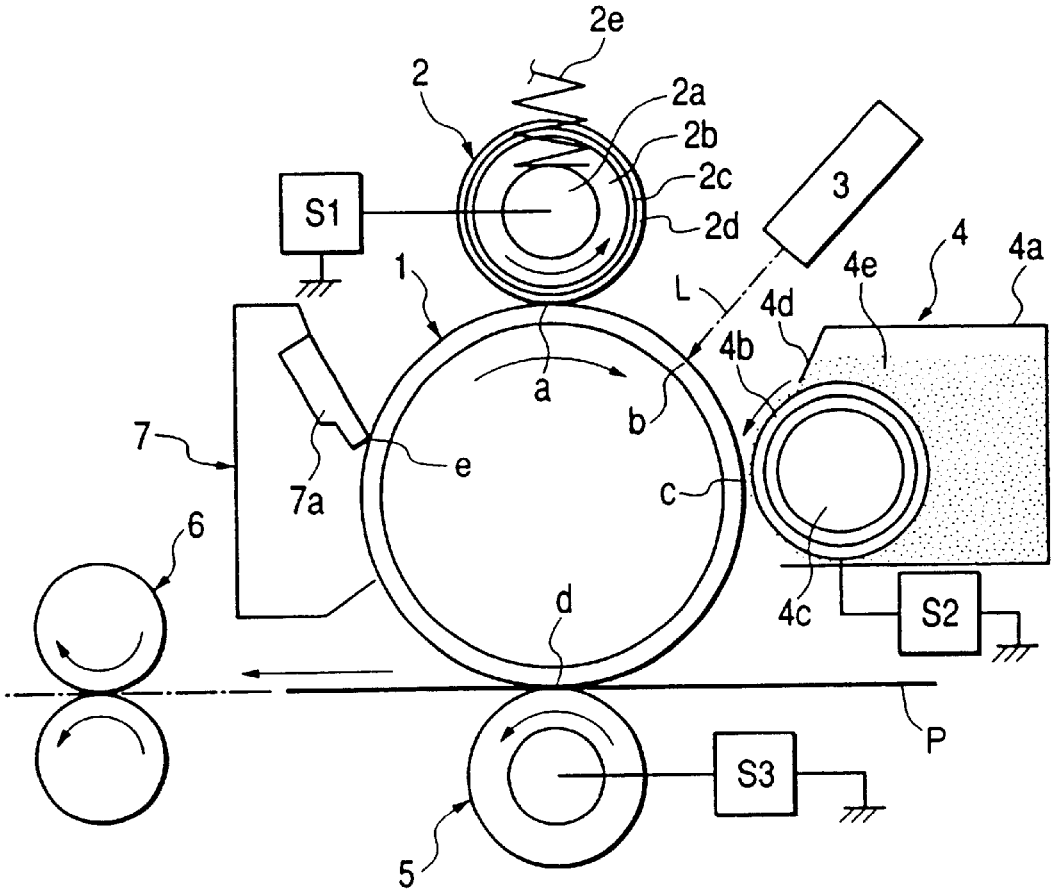
FIG. 1 is a schematic configurational diagram of an image forming apparatus according to a first embodiment.

FIG. 1 is a schematic configurational diagram of an image forming apparatus according to the present invention. The image forming apparatus according to a first embodiment is a contact electrification, reversal development type laser beam printer which utilizes a transfer type electrophotographic process and has a maximum sheet passage size of A3.

(1) Overall configuration of printer a) Image bearing body

Reference numeral 1 denotes a rotating drum type electrophotographic photosensitive body (hereinafter referred to as a photosensitive drum) which is used as an image bearing body. This photosensitive drum 1 is a negatively chargeable organic photoconductive body (OPC) which has an outside diameter of 25 mm and is rotatingly driven in a counterclockwise direction indicated by an arrow around a center support shaft at a process speed (peripheral speed) of 100 mm/sec.

Figure 2:
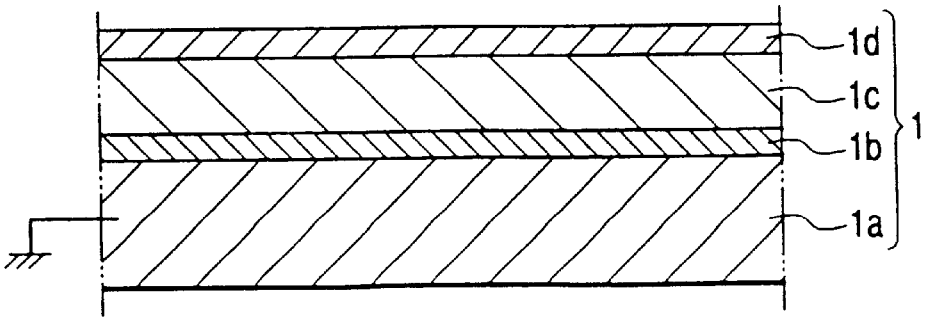
FIG. 2 is a diagram showing a layer configuration of a photosensitive body.

This photosensitive drum 1 is configured by three layers of a base layer 1*b* for suppressing interference of rays and enhancing adhesion of an upper layer, a photoelectric charge generating layer 1*c* and an electric charge conveying layer 1*d* which are coated over a surface of an aluminium cylinder (electrically conductive drum substrate) 1*a* in an order from a downside as shown in FIG. 2 which is a layer configurational diagram.

b) Electrifying device

Reference numeral 2 denotes a contact electrifying device (contact electrifier) which is used as a device for uniformly electrifying a circumferential surface of the photosensitive drum 1 and an electrifying roller (roller electrifier) is used in the first embodiment.

A core metal 2*a* is rotatably held at both ends by bearing members (not shown) and urged toward the photosensitive drum by a push spring 2*e*, whereby the electrifying roller 2 is kept in contact with the surface of the photosensitive drum 1 under a predetermined pressure and rotates while following a rotation of the photosensitive drum 1. Portions of the photosensitive drum 1 and the electrifying roller 2 which are kept in contact under the pressure constitute an electrifying portion (electrifying nip portion) a.

An electrifying bias voltage is applied from a power supply S1 to the core metal 2*a* of the electrifying roller 2 in a predetermined condition, whereby the circumferential surface of the rotating photosensitive drum 1 is uniformly electrified negatively in the first embodiment.

A configuration of the above-described electrifying roller 2, an electrification control method or the like will be described in detail in section (3).

c) Information write device

Reference numeral 3 denotes an exposure device which is used as an information write device for forming an electrostatic latent image on an electrified surface of the photosensitive drum 1 and a laser beam scanner using a semiconductor laser is used as the exposure device in the first embodiment. The information write device outputs a laser beam which is modulated in correspondence to an image signal sent from a host apparatus such as an image reading apparatus (not shown) to a side of a printer, thereby performing laser scanning exposure L (image scanning exposure) of the uniformly electrified surface of the rotating photosensitive drum 1 at an exposure portion b. By this laser scanning exposure L, a potential is lowered in an area of the surface of the photosensitive drum 1 which has been irradiated with the laser beam, whereby an electrostatic latent image corresponding to scanned and exposed image information is consecutively formed on the surface of the rotating photosensitive drum 1.

d) Developing device

Reference numeral 4 denotes a developing device which visualizes the electrostatic latent image by supplying a toner to the electrostatic latent image on the photosensitive drum 1 and a jumping developing device (development counter) is used in the first embodiment. The electrostatic latent image formed on the surface of the photosensitive drum 1 is developed in reversal by the developing device 4 using a negatively electrified single-component magnetic toner (negative toner).

Reference numeral 4*a* denotes a developer container and reference numeral 4*b* denotes a non-magnetic developing sleeve which is disposed rotatably in the developing container 4*a* in a condition where a portion of an outer circumferential surface of the developing sleeve 4*b* is exposed outside. Reference numeral 4*c* denotes a magnet roller which is inserted into the developing sleeve 4*b* and fixed so as not to rotate, reference numeral 4*d* denotes a developer coating blade, reference numeral 4*e* denotes a single-component magnetic toner contained in the developer container 4*a* as a developer and reference character S2 denotes a power supply which applies a developing bias voltage to the developing sleeve 4*b*.

The single-component magnetic toner is coated as a thin layer on a surface of the developing sleeve 4*b* rotating in the counterclockwise direction indicated by the arrow. The toner is conveyed to a developing portion c and allowed to selectively adhere to the surface of the photosensitive drum 1 due to an electric field produced by the developing bias voltage in correspondence to an electrostatic latent image, whereby the electrostatic latent image is developed as a toner image. In case of the first embodiment the tone-!r adheres to an exposed bright area of the surface of the photosensitive drum 1 thereby developing the electrostatic latent image in reverse.

After passing through the developing portion c, the thin layer of the developer on the developing sleeve 4*b* is returned into a developer reservoir in the developer container 4*a* as the developing sleeve rotates.

e) Transferring device, fixing device and cleaning device

Reference numeral 5 denotes a transferring device which is a transferring roller in the first embodiment. This transferring roller 5 is kept in contact with the photosensitive drum 1 under a predetermined pressure and a pressure contact nip portion constitutes a transferring portion d. A transferring material (transferring member or recording material) P is fed from a sheet feeding mechanism section (not shown) to the transferring portion d at a timing which is controlled as predetermined.

The transferring material P which is fed to the transferring portion d is sandwiched and conveyed between the photosensitive drum 1 and the transferring roller 5, and in this while, a transferring bias voltage having a positive polarity reverse to the negative polarity which is a regular polarity of the toner is applied to the transferring roller 5 from a power supply S3, whereby the toner image is electrostatically transferred from the surface of the photosensitive drum 1 consecutively to a surface of the transferring material P which is sandwiched and conveyed through the transferring portion d.

The transferring material P which has passed through the transferring portion d and to which the toner image has been transferred is consecutively separated from the surface of the rotating photosensitive drum 1, conveyed to a fixing device 6 (for example, a heat roller fixing device), subjected to a toner image fixing treatment and output as an article having formed image (print or copy).

Reference numeral 7 denotes a cleaning device, and the surface of the photosensitive drum 1 which has transferred the toner image to the transferring material P is frictionally rubbed by a cleaning blade 7*a* to remove the toner remaining after transferring and cleaned into a clean surface for repeated use for image formation. Reference character e denotes a portion of the cleaning blade 7*a* which is brought into contact with the surface of the photosensitive drum.

(2) Operating sequence of printer

Figure 3:
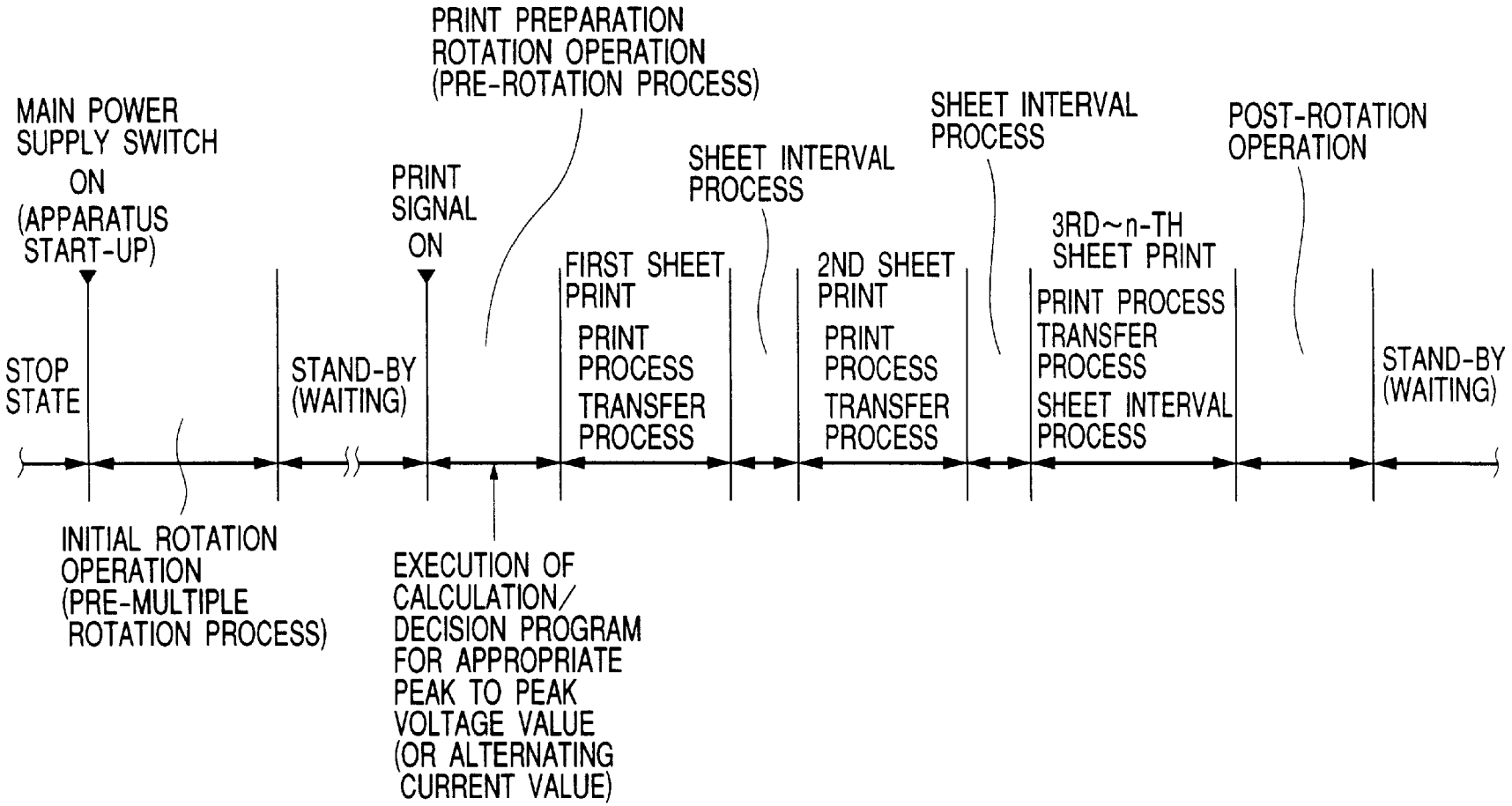
FIG. 3 is a diagram showing an operating sequence of an image forming apparatus.

FIG. 3 is an operating sequence diagram of a printer.

a. Initial rotation operation (pre-multiple rotation process)

This is an initiating operation process (start operation process or a warm-up process) at a start time of the printer. When a power supply switch is turned on, the printer rotatingly drives the photosensitive drum and executes preparatory operations for predetermined process appliances such as heating of the fixing device to a predetermined temperature.

b. Print preparation rotation operation (pre-rotation process)

This is a preparation rotation operation process which ranges from a moment that a print signal is turned on to an actual image formation (print) process and is executed successively to the initial rotation operation when the print signal is input during the initial rotation operation. When the print signal is not input, after completing the initial rotation operation the printer stops the rotating drive of the photosensitive drum by once stopping drive of a main motor and is set in a stand-by (waiting) condition until the print signal is input. The print preparation rotation operation is executed when the print signal is input.

In the first embodiment, a calculation/decision program for calculating an appropriate peak to peak voltage value (or alternating current value) of an alternating voltage to be applied at an electrifying step of a print process is executed at the print preparation rotation operation process. This will be described in detail later in section (3).

c. Print process (image formation process or imaging process)

Upon completing the predetermined print preparation rotation operation, an imaging process is executed for the rotating photosensitive drum, the toner image formed on the surface of the rotating photosensitive drum is transferred to the transferring material and fixed by the fixing device and an article having formed image is printed out.

In case of a successive print mode the above described print process is executed repeatedly for the number of prints selected.

d. Sheet interval process

This is a process in the successive print mode at which no recording sheet passes through the transferring portion d after a rear end of the transferring material has passed through the transferring portion d until a front end of a next transferring material reaches the transferring portion d.

e. Post-rotation operation

This is a process at which predetermined post-operations are executed by continuing the drive of the main motor for some while and rotatingly driving the photosensitive drum even after completing the print process for a last transferring material.

f. Stand-by

Upon completion of the predetermined post-rotation, the rotational drive of the photosensitive drum is stopped by stopping the drive of the main motor and the printer is maintained in a stand-by state until a next print start signal is input.

When only a copy is printed does the printer perform the post-rotation operation. At other times it enters into the stand-by state after completing the print.

When the print start signal is input in the stand-by state, the printer proceeds to the pre-rotation process.

An image formation process is the print process c, whereas the initial rotation operation a, pre-rotation operation b, sheet interval process d and post-rotation operation e are no-image formation processes.

(3) Detailed description of electrifying device

A) Electrifying roller 2

The electrifying roller 2 which is used as a contact electrifying member has a longitudinal length of 320 mm, and a three-layer configuration consisting of a lower layer 2*b,* an intermediate layer 2*c* and a surface layer 2*d* which are laminated consecutively from a downside around the core metal (support member) 2*a* as shown in FIG. 1 which is a layer configurational diagram. The lower layer 2*b* is an expanded sponge layer which is adopted for lowering an electrifying sound, the intermediate layer 2*c* is an electrically conductive layer which is used for obtaining uniform resistance throughout the electrifying roller and the surface layer 2*d* is a protective layer which is disposed to prevent leak from occurring even when the photosensitive drum 1 has defects such as pinholes.

More specifically, the electrifying roller 2 in the first embodiment has specifications described below.

Core metal 2*a;* Round stainless steel bar having a diameter of 6 mm

Figure 4:
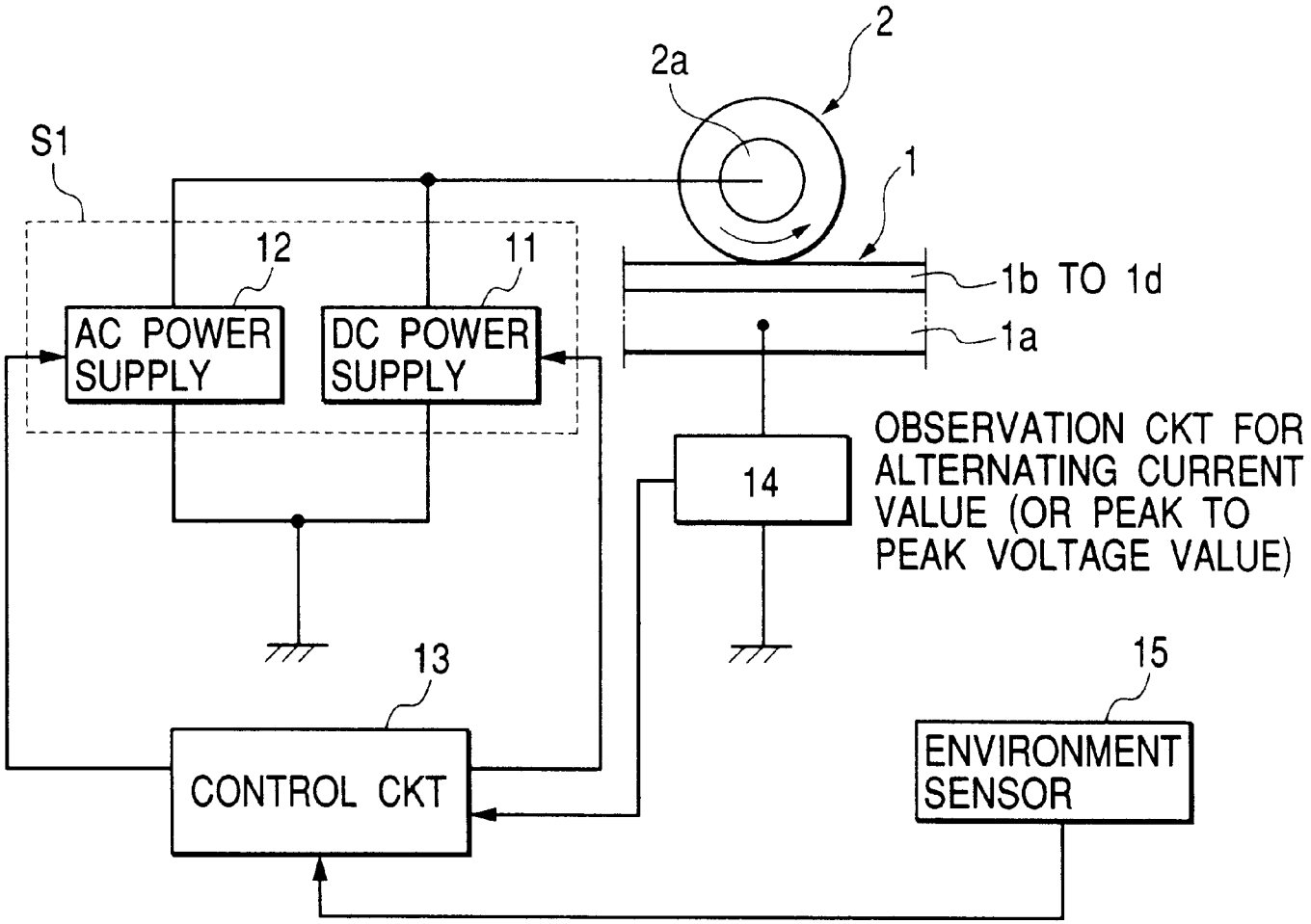
FIG. 4 is a block circuit diagram of an electrifying bias voltage application system.

Lower layer 2*b;* Expanded EPDM containing dispersed carbon, specific gravity 0.5 g/cm$^3$, volume resistance value $10^3$ Ωcm, layer thickness 3.0 mm, length 320 mm Intermediate layer 2*c;* NBR-based rubber containing dispersed carbon, volume resistance value $10^5$ Ωcm, layer thickness 700 μm Surface layer 2*d;* Toresin resin of fluorine compound containing dispersed tin oxide and carbon, volume resistance value $10^8$ Ω cm, surface roughness (JIS average surface roughness at 10 points Ra) 1.5 μm, layer thickness 10 μm B) Electrifying bias voltage application system FIG. 4 is a block circuit diagram of a bias voltage application system for the electrifying roller 2.

The circumferential surface of the rotating photosensitive drum 1 is electrified to a predetermined potential by applying a predetermined oscillating voltage (bias voltage Vdc+Vac) consisting of an AC voltage having a frequency f overlapped with a DC voltage from the power supply S1 to the electrifying roller 2 by way of the core metal 2*a*.

The power supply S1 which is a voltage application device for the electrifying roller 2 has a DC power supply 11 and an AC power supply 12.

Reference numeral 13 denotes a control circuit which has a function to control the DC power supply 11 and the AC power supply 12 of the above described power supply S1 so as to apply a DC voltage, an AC voltage or an overlapped voltage of both the DC and AC voltages to the electrifying roller 2, and another function to control peak to peak voltage values of the DC voltage value to be applied to the electrifying roller 2 from the DC power supply 11 and the AC voltage to be applied to the electrifying roller 2 from the AC power supply 12.

Reference numeral 14 denotes an alternating current value observation circuit which functions as a device for measuring an alternating current supplied to the electrifying roller 2 by way of the photosensitive body 1. Measured alternating current value information is input from this circuit 14 into the above described control circuit 13.

Reference numeral 15 denotes an environment sensor (a thermometer and a hygrometer) functioning as a device for detecting an environment in which the printer is installed. Detected environment information is input from this environment sensor 15 into the above described control circuit 13.

The control circuit 13 has a function to execute the calculation/decision program for appropriate peak to peak voltage value of the alternating voltage to be applied to the electrifying roller 2 at the electrifying step of the print process from the alternating current value information input from the alternating current value observation circuit 14 and the environment information input from the environment sensor 15.

C) Control method of peak to peak voltage of alternating voltage

Now, description will be made of a method to control the peak to peak voltage of the alternating voltage to be applied to the electrifying roller 2 at the print process.

From various kinds of examinations, the inventors have found that the amount of discharge current which is numerically expressed by the function described below indicates an amount of an actual AC discharge and is strongly correlated to cutting of a photosensitive drum image flow and electrification uniformity.

Figure 5:
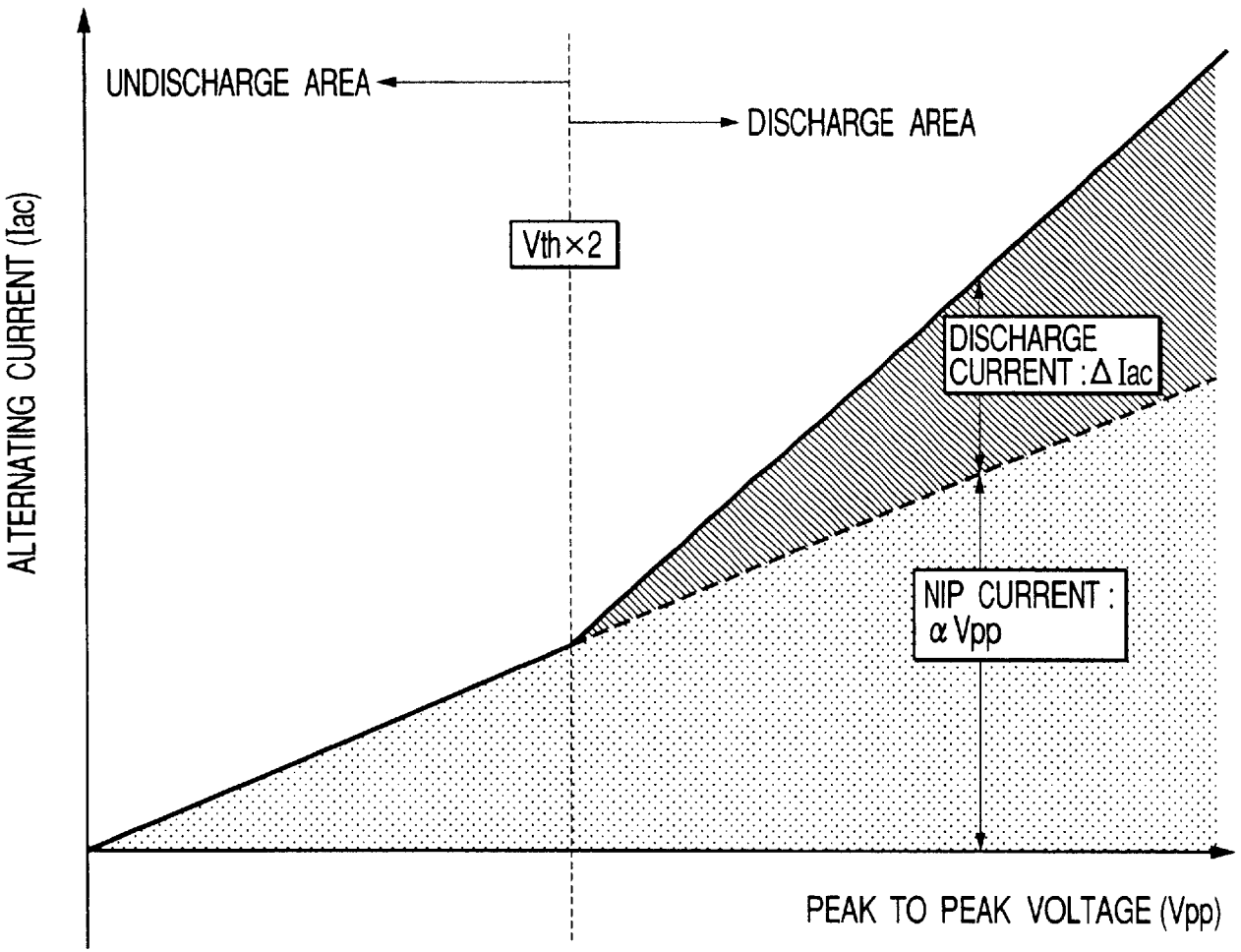
FIG. 5 is a schematic diagram descriptive of a measurement of an amount of discharge current.

An alternating current Iac is in a linear relation to a peak to peak voltage Vpp at voltages lower than a discharge start voltage Vth×2 (V) (in an undischarge area) and gradually deviated in an increasing direction in a discharge area at higher voltages as shown in FIG. 5. Since the linear relation is maintained in a similar experiment effected in a vacuum in which discharge does not occur, it is conceived that the deviation in the increasing direction is an increment ΔIac which plays a part in discharge.

When a ratio of the current Iac relative to the peak to peak voltage Vpp lower than the discharge start voltage Vth×2 (V) is represented as α, an alternating current supplied to a contact portion (hereinafter referred to as a nip current) other than a current supplied by discharge is α·Vpp, and a difference ΔIac between Iac which is measured during application of a voltage not lower than the discharge start voltage Vth×2 (V) and α·Vpp $$\Delta Iac = Iac - \alpha \cdot Vpp \qquad \text{Formula 1}$$

formula 1 is defined as the amount of discharge current which substitutionally indicates the amount of discharge.

When electrification is effected while controlling a voltage or a current to a constant level, this amount of discharge current changes depending on enviromental factors and as the printer is used over time. This is because the relation between the peak to peak voltage and the amount of discharge current and a relation between the alternating current value and the amount of discharge current changes.

The AC constant current control method controls a total current supplied from an electrifying member to a body to be electrified. An amount of the total current is a sum of the nip current α·Vpp and the amount of discharge current ΔIac which is supplied by discharge to a non-contact portion, and the constant current control method controls not only the discharge current which is required for actually electrifying the body to be electrified but also the nip current.

Accordingly, the constant current control method cannot actually control the amount of discharge current. Even while the constant current control methods by an identical current value, the amount of discharge current is decreased when the nip current is enhanced due to an enviromental change of a material of the electrifying member or increased when the nip current is lowered, whereby even the AC constant current control method is incapable of completely suppressing the increase and decrease of the amount of discharge current. For this reason, the constant current method is not capable or realizing compatibility between prevention of cutting of a photosensitive drum and electrification uniformity.

Denoting a desired amount of discharge current by D, description will be made of a method to decide a peak to peak voltage which gives the amount of discharge current D.

At the print preparation rotation operation process in the first embodiment, the control circuit 13 executes the calculation/decision program for appropriate peak to peak voltage value of the alternating voltage to be applied to the electrifying roller 2 at the electrifying step of the print process.

Specific description will be made with reference to a Vpp-Iac graph shown in FIG. 6 and a control flow chart shown in FIG. 7.

Figure 6:
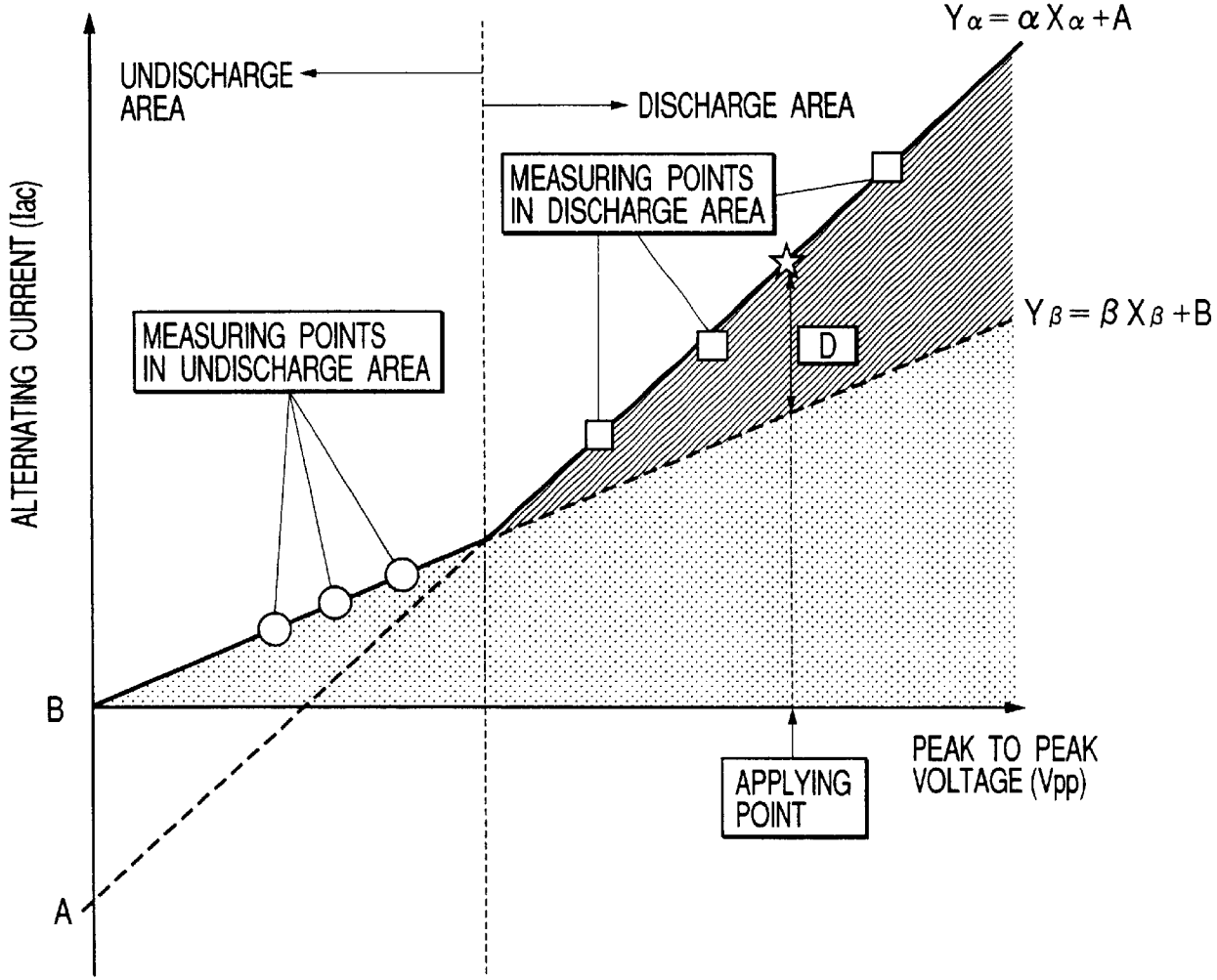
FIG. 6 is a diagram showing relations between peak to peak voltages and alternating current values to be measured during a print preparation rotation operation.
Figure 7:
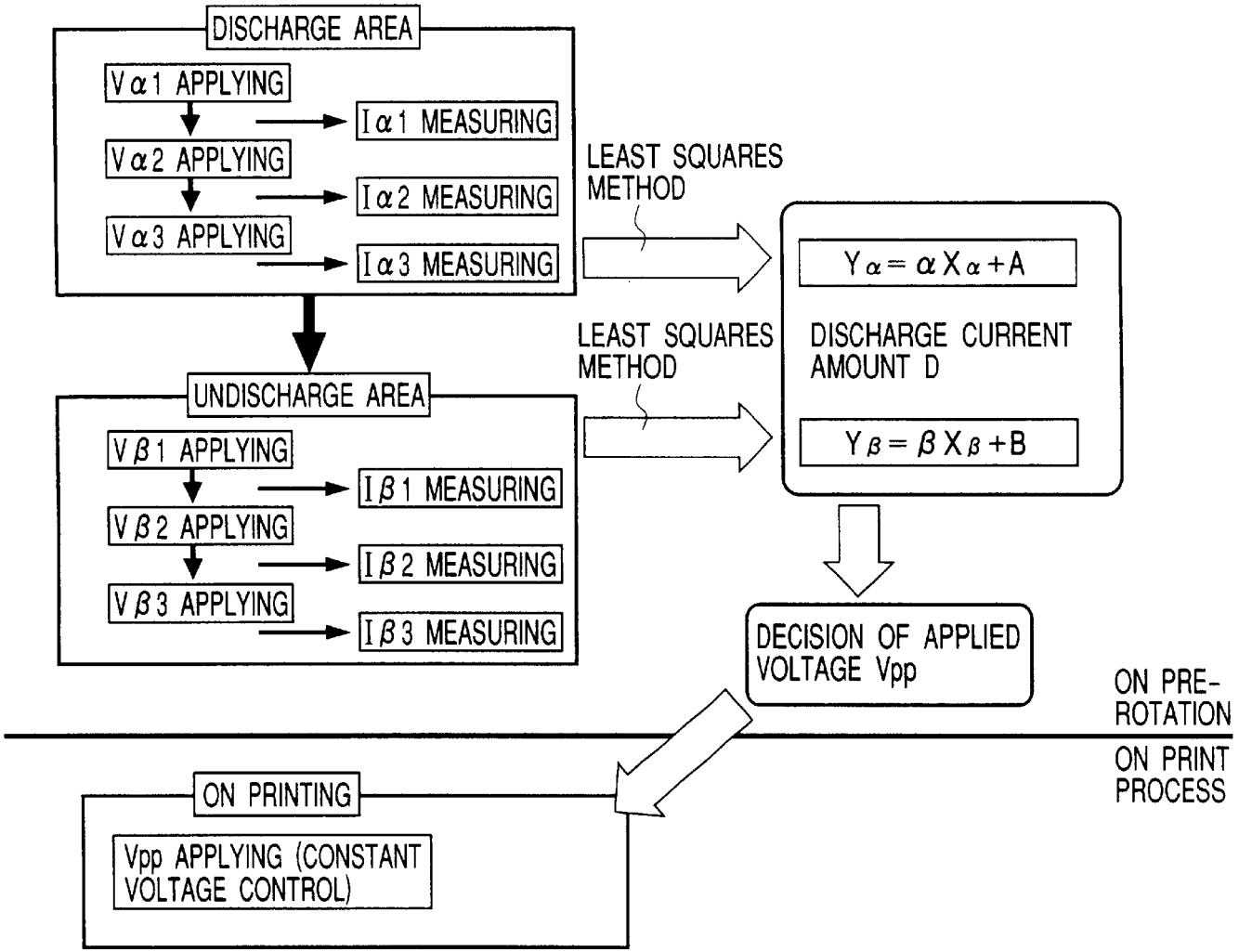
FIG. 7 is a flowchart descriptive of the electrification control.

The control circuit 13 controls the AC power supply 12 so that peak to peak voltages (Vpp) are consecutively applied to the electrifying roller 2 at three points in the discharge area and at three points in the undischarge area as shown in FIG. 6, and an alternating current values supplied to the electrifying roller 2 by way of the photosensitive body 1 are measured by the alternating current value observation circuit 14 and input into the control circuit 13.

From the current values measured at the three points, the control circuit 13 approximates a relation between the peak to peak voltages and the alternating currents in each of the discharge area and the undischarge area to a straight line using a least squares method, and calculates the following equations 2 and 3.

Equation 2 . . . Approximate straight line in discharge area:

$$Y_\alpha = \alpha X + A$$

Equation 3 . . . Approximate straight line in undischarge area:

$$Y_\beta = \beta X + B$$

Then, a difference between the approximate straight line in the discharge area expressed by the above described equation 2 and the approximate straight line in the undischarge area expressed by the equation 3 is determined according to a formula 4 as the peak to peak voltage Vpp which gives the amount of discharge current D.

$$Vpp = (D - A + B)/(\alpha - \beta) \qquad \text{Formula 4}$$

wherein functions fI1 (Vpp) and fI2 (Vpp) of peak to peak voltage (Vpp)-alternating current (Iac) in the undischarge area and the discharge area which are mentioned in the claim correspond to $Y_\beta = \beta X_\beta + B$ of the above described equation 3 and $Y_\alpha = \alpha X_\alpha + A$ of the above described equation 2. Furthermore, a constant D described in the claim corresponds to the above described amount of discharge current D.

Accordingly, fI2 (Vpp)−fI1 (Vpp)=D described in the claims is:

$$Y_\alpha - Y_\beta = (\alpha X_\alpha + A) - (\beta X_\beta + B) = D$$

Furthermore, from fI2 (Vpp)−fI1 (Vpp)=D, the formula 4 is derived as follows:

$$Vpp = (D - A + B)/(\alpha - \beta)$$

$$fI2\ (Vpp) - fI1\ (Vpp) = Y_\alpha - Y_\beta = D$$

$$(\alpha X_\alpha + A) - (\beta X_\beta + B) = D$$

A point Vpp at which X has a value giving D is $$(\alpha Vpp + A) - (\beta Vpp + B) = D$$

Hence, we obtain:

$$Vpp = (D - A + B)/(\alpha - \beta)$$

The control circuit 13 switches the peak to peak voltage to be applied to the electrifying roller 2 to Vpp calculated according to the above described formula 4, controls a voltage to a constant level of Vpp and proceeds to the above described print process.

By calculating at each print preparation rotation operation process a peak to peak voltage required for obtaining a predetermined amount of discharge current at the print process and controlling the calculated peak to peak voltage to a constant level at the print process, it is possible to absorb fluctuations of a resistance value due to manufacturing dispersion of the electrifying roller 2, environmental changes of materials and high voltage dispersion of the image forming apparatus main unit, thereby securely obtaining a desired amount of discharge current.

Durability tests effected by this control method indicated no deterioration or cutting of a photosensitive drum used as an image bearing body in any environment, thereby enabling to prolong a service life of the photosensitive drum approximately 10% as compared with the conventional constant current control method.

Though the amount of discharge current is controlled by switching the peak to peak voltage of the alternating voltage to be applied to the electrifying roller in the first embodiment, the present invention is not limited by the embodiment and it is possible to measure a peak to peak voltage of an alternating voltage by reversely applying an alternating current (by modifying the alternating current value observation circuit 14 into a peak to peak voltage value observation circuit in FIG. 4) and control an output alternating current from an AC power supply with the control circuit 13 so that an alternating current required for obtaining a desired amount of discharge current can always be applied at the print process.

Though the desired amount of discharge current D and the peak to peak voltage value to be applied at the print preparation rotation operation process are constant in all environments in the first embodiment, uniform electrification can be performed more stably in a printer which comprises the environment sensor 15 (thermometer and hygrometer) when the amount of discharge current D and the peak to peak voltage are varied dependently on environments.

When the peak to peak voltage to be applied at the print process is determined by applying the peak to peak voltages to the electrifying roller 2 at several points in the undischarge area and measuring alternating voltage values sequentially at several points in the discharge area at the print preparation rotation operation process, it is possible to apply the peak to peak voltage or the alternating current which always gives a desired amount of discharge current, thereby enabling to obtain compatibility of prevention of deterioration and cutting of the photosensitive body with electrification uniformity, prolong a service life of a printer and enhance qualities of images.

Furthermore, the control method according to the present invention makes it possible to absorb manufacturing dispersion and broaden ranges allowable for materials and manufacturing precision, thereby enabling to lower a manufacturing cost and provide inexpensive products to users.

Figure 8:
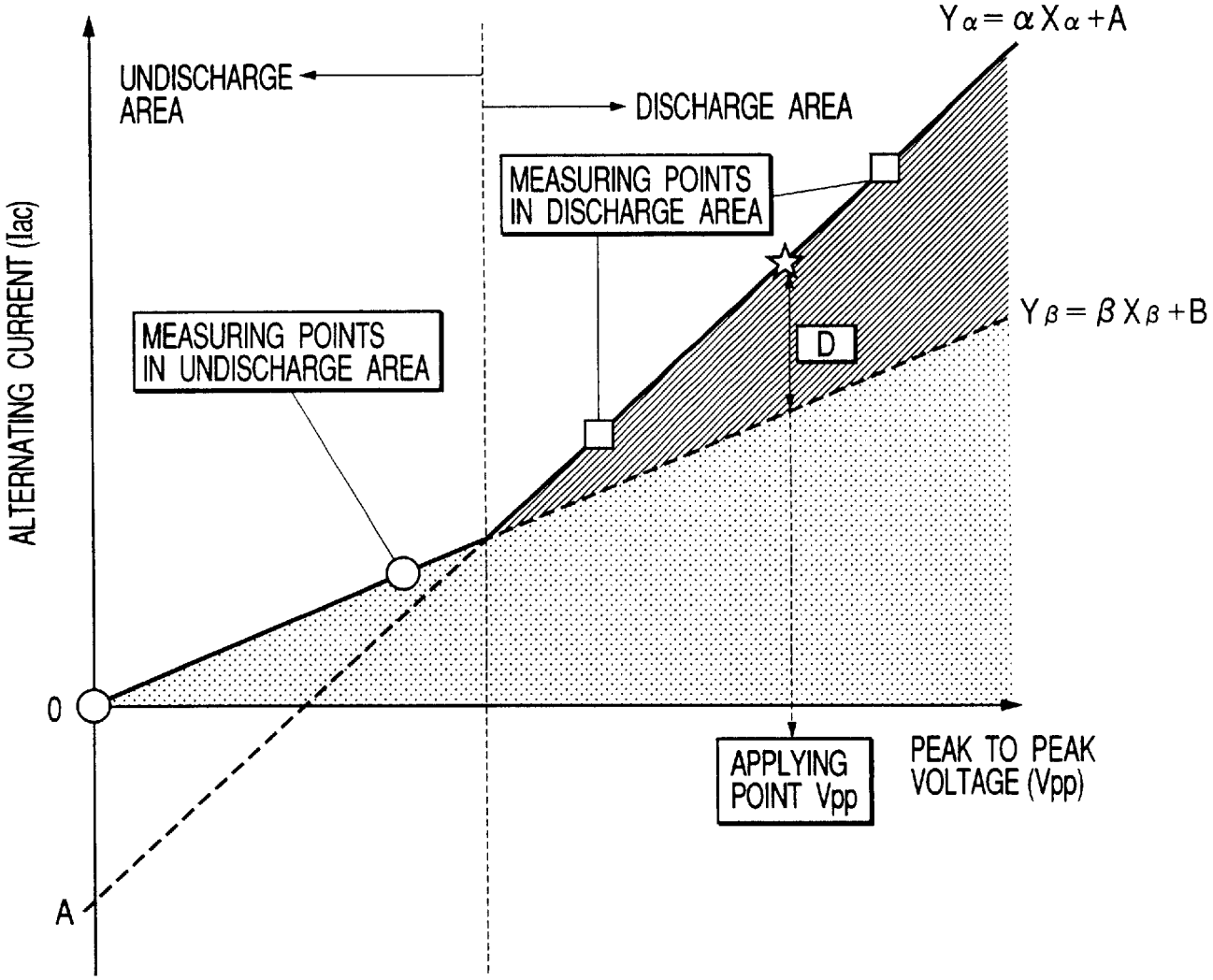
FIG. 8 is a diagram showing relations between peak to peak voltages and alternating current values to be measured during the print preparation rotation operation in a second embodiment.

<Second embodiment> (FIG. 8)

A second embodiment is a constant voltage control system for control at a point. An image forming apparatus applies peak to peak voltages (Vpp) to an electrifying roller sequentially at two points in a discharge area and at a point in a undischarge area, and measures alternating current values at these points at a print preparation rotation operation process as shown in FIG. 8. A relation between the peak to peak voltages and alternating currents is preliminarily set so that the alternating current value is zero when the peak to peak voltage is zero.

Next, the image forming apparatus approximates the relation between the peak to peak voltages and the alternating currents to a straight line using values measured at the two points in the discharge area and a measured value and a 0 point in the undischarge area and calculates the following equations 2 and 3:

Equation 2 . . . Approximate straight line in discharge area:

$$Y_\alpha=\alpha X_\alpha+A$$

Equation 3 . . . Approximate straight line in undischarge area:

$$Y_\beta=\beta X_\beta$$

Then, the image forming apparatus determines a difference between the approximate straight line $Y_\alpha$ in the discharge area and the approximate straight line $Y_\beta$ in the undischarge area as a peak to peak voltage Vpp which gives an amount of discharge current D according to a formula 4.

$$Vpp=(D-A)/(\alpha-\beta) \qquad \text{Formula 4}$$

The image forming apparatus switches a peak to peak voltage to be applied to an electrifying member to the calculated Vpp (constant voltage control at Vpp) and proceeds to the above described image forming operation process.

The image forming apparatus which has such a control configuration is capable of obtaining an effect similar to that of the first embodiment with a smaller number of measuring points.

An image forming apparatus which uses a control system for control at a point in a wide sense like the second embodiment is capable of determining a relation between peak to peak voltages and an alternating currents using no zero point but a point at which a preliminarily known amount of a current is supplied at a certain Vpp or obtaining the relation between the peak to peak voltages and the alternating currents by measuring the alternating current at least at a point.

Figure 9:
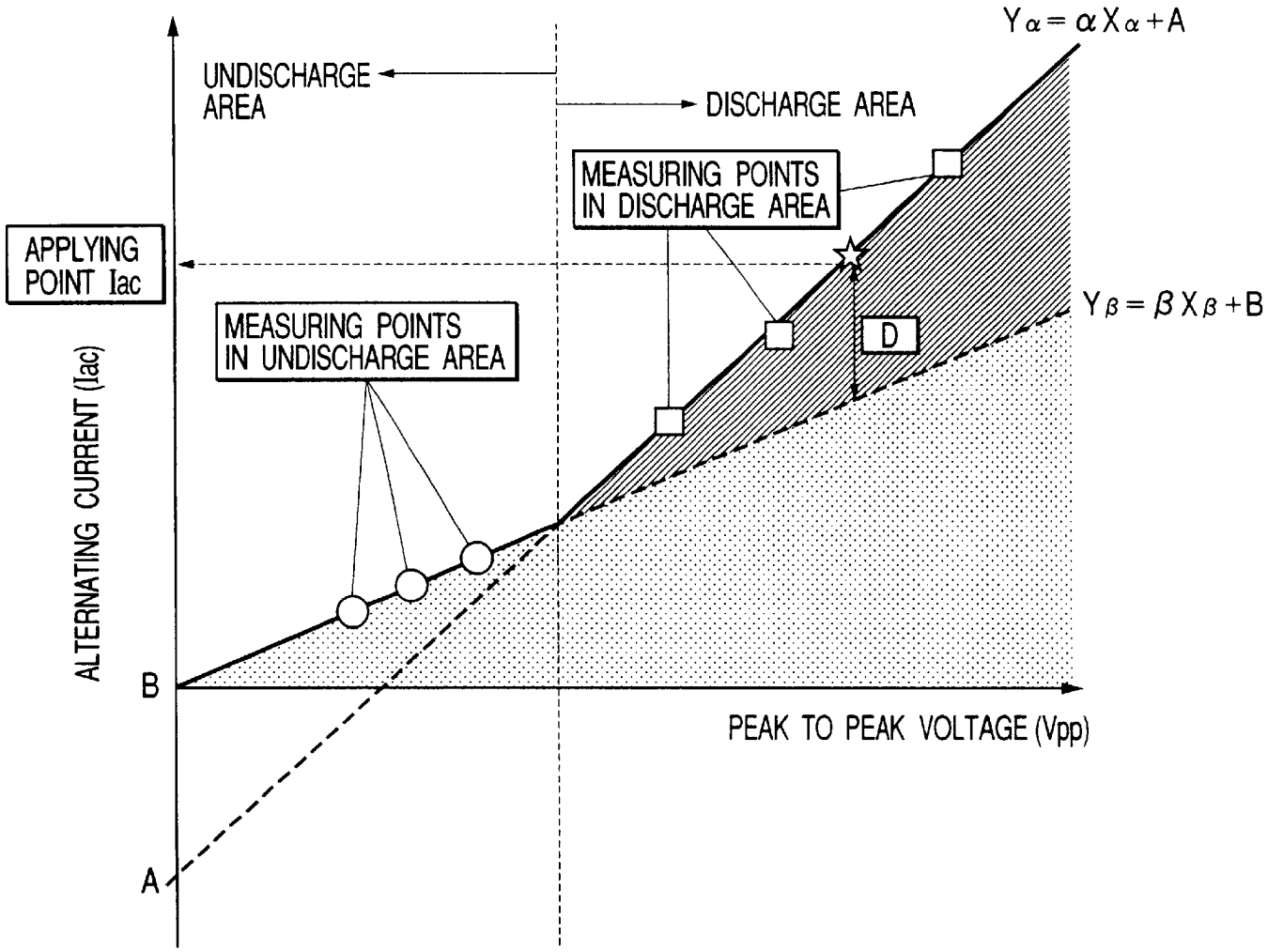
FIG. 9 is a diagram showing relations between peak to peak voltages and alternating current values to be measured during the print preparation rotation operation in a third embodiment.

<Third embodiment> (FIG. 9)

A third embodiment is a constant current control system for control at three points and description will be made of a method which determines an alternating current value which gives an amount of discharge current D taking a desired amount of discharge current as D.

An image forming apparatus consecutively applies an alternating currents (Iac) to an electrifying roller at three points in a discharge area and at three points in an undischarge area, and measures peak to peak voltages at these points at the print preparation rotation operation process as shown in FIG. 9.

Then, the image forming apparatus approximates a relation between peak to peak voltages and the alternating currents in each of the discharge area and the undischarge area from the current values measured at the three points to a straight line using the least squares method, thereby calculating the following equations 2 and 3.

Equation 2 . . . Approximate straight line in discharge area:

$$Y_\alpha=\alpha X_\alpha+A$$

Equation 3 . . . Approximate straight line in undischarge area:

$$Y_\beta=\beta X_\beta+B$$

Then, the image forming apparatus determines a difference between the approximate straight line $Y_\alpha$ in the discharge area and the approximate straight line $Y_\beta$ in the undischarge area as the alternating current (Iac) which gives the amount of discharge current D according to a formula 4.

When an alternating current value which gives D is represented by Iac1 and a peak to peak voltage at that current is denoted by Vpp, the equation 2 and the equation 3 are:

$$Iac1=\alpha Vpp+A \quad \text{formula a}$$

$$Iac2=\beta Vpp+B \quad \text{formula b}$$

wherein Iac2 is an alternating current value which gives Vpp on the approximate straight line $Y_\beta$ in the undischarge area.

$$Iac1=Iac2+D \quad \text{formula c}$$

From the formulae a, b and c, the alternating current (Iac) which gives the amount of discharge current D is determined by a formula 4.

$$Iac=(\alpha D+\alpha B-\beta A)/(\alpha-\beta) \quad \text{Formula 4}$$

The image forming apparatus switches an alternating current to be applied to an electrifying member to determined Iac, performs constant current control at Iac and proceeds to the above described image forming operation process.

Figure 10:
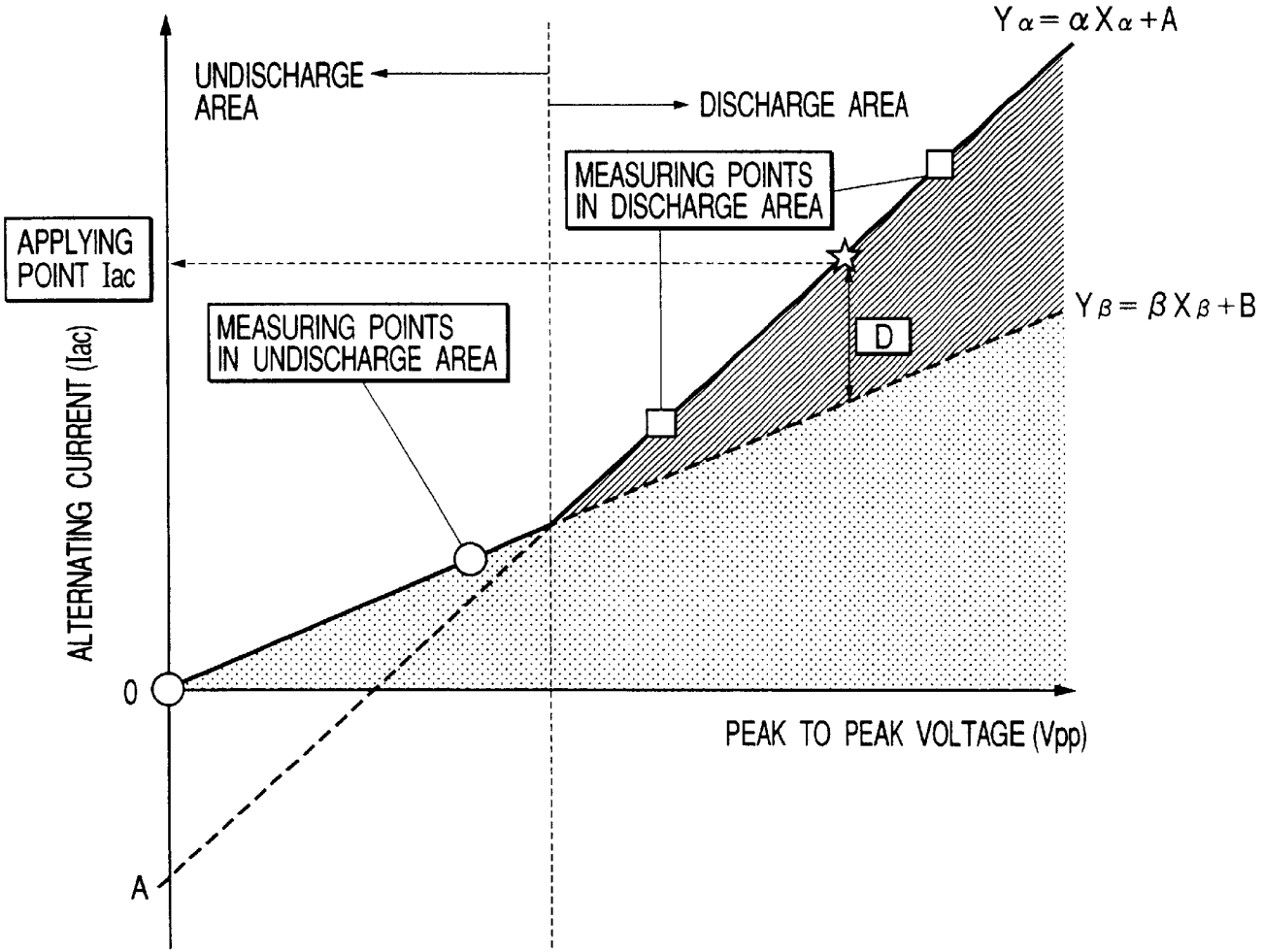
FIG. 10 is a diagram showing relations between peak to peak voltages and alternating current values to be measured during the print preparation rotation operation in a fourth embodiment.

<Fourth embodiment> (FIG. 10)

A fourth embodiment is a constant current control system for control at a point and description will be made of a method for determining an alternating current value which gives an amount of discharge current D taking a desired amount of discharge current as D.

An image forming apparatus applies alternating currents (Iac) to an electrifying roller consecutively at two points in a discharge area and at a point in the undischarge area at the print preparation rotation operation process, and measures peak to peak voltages at these points as shown in FIG. 10.

Then, the image forming apparatus approximates a relation between the peak to peak voltages and the alternating currents to a straight line using values measured at the two points in the discharge area and a measured value and a 0 point in the undischarge area, thereby calculating the following equations 2 and 3.

Equation 2 . . . Approximate straight line in discharge area:

$$Y_\alpha=\alpha X_\alpha+A$$

Equation 3 . . . Approximate straight line in undischarge area:

$$Y_\beta=\beta X_\beta$$

Then, the image forming apparatus determines a difference between the approximate straight line $Y_\alpha$ in the discharge area and the approximate straight line $Y_\beta$ in the undischarge area as the alternating current (Iac) which gives the amount of discharge current D according to a formula 4.

When an alternating current value which gives D is represented by Iac1 and a peak to peak voltage at that current is denoted by Vpp, the equations 2 and 3 are:

$$Iac1=\alpha Vpp+A \quad \text{formula a}$$

$$Iac2=\beta Vpp \quad \text{formula b}$$

wherein Iac2 is an alternating current value which gives Vpp on the approximate straight line $Y_\beta$ in the undischarge area.

$$Iac1-Iac2=D \quad \text{formula c}$$

From the formulae a, b and c, the alternating current (Iac) which gives the amount of discharge current D is determined according to the formula 4.

$$Iac=(\alpha D-\beta A)/(\alpha-\beta) \quad \text{Formula 4}$$

The image forming apparatus switches the alternating current to be applied to an electrifying member to the determined Iac, performs constant current control at Iac and proceeds to the above described image forming operation process.

Figure 11:
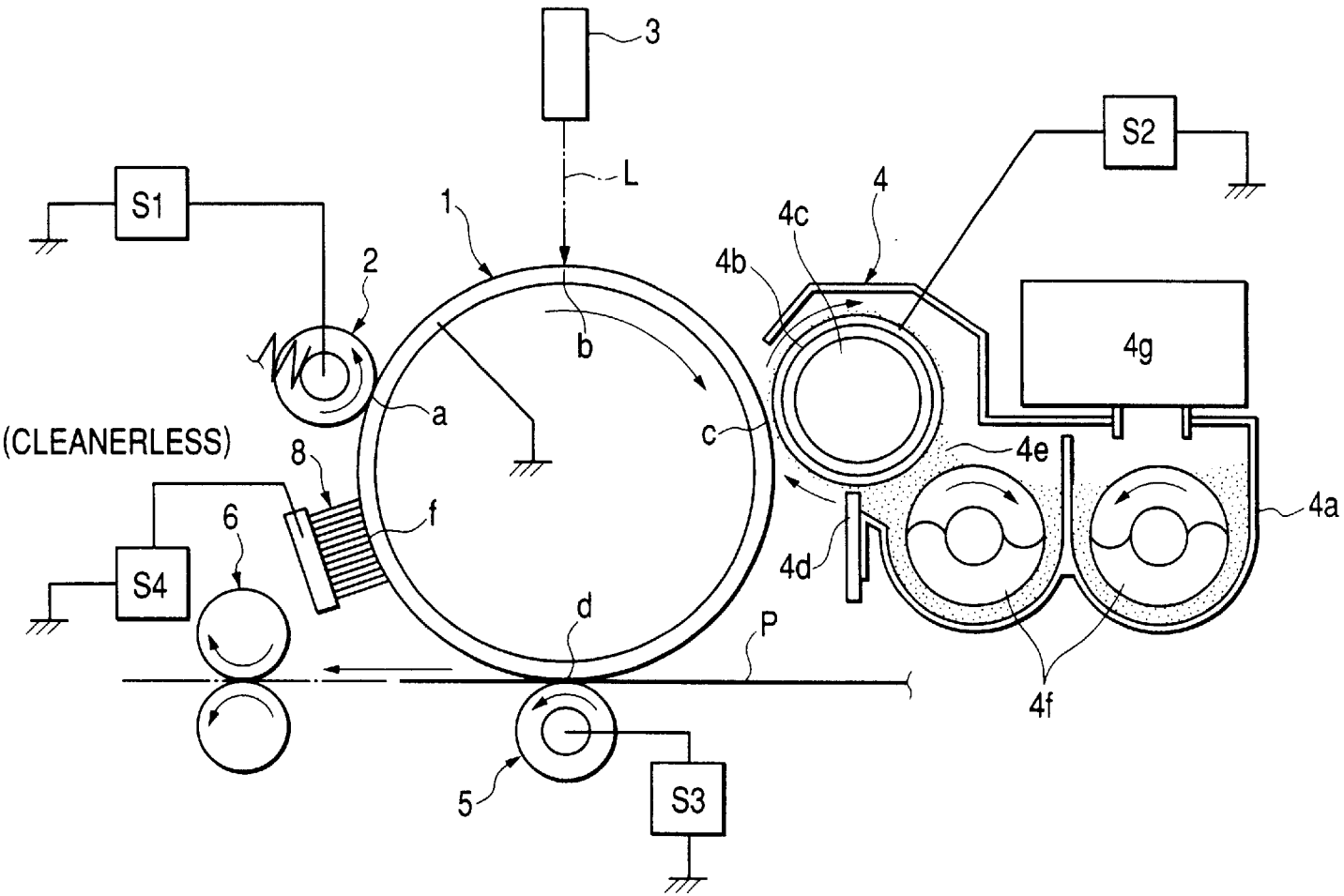
FIG. 11 is a schematic configurational diagram showing an image forming apparatus (cleanerless) according to a fifth embodiment.

<Fifth Embodiment> (FIG. 11)

FIG. 11 is a schematic configurational diagram of an image forming apparatus according to a fifth embodiment. The image forming apparatus according to the fifth embodiment is a contact electrification reversal development type cleanerless laser beam printer which utilizes a transfer type electrophotographic process and has a maximum sheet passage size of A3.

While denoting component members and parts which are the same as those in the above-descibed first embodiment by the same reference numerals to omit repetitive description, description will be made of component members, parts and items which are different from those of the printer according to the first embodiment.

(1) Outline of overall configuration of printer

A photosensitive drum 1 which is used in the printer according to the fifth embodiment has an outside diameter of 50 mm.

A developing device 4 is a two-component magnetic brush developing type reversal developing device and an electrostatic latent image formed on a surface of the photosensitive drum 1 is consecutively developed in reversal by the developing device 4 as a toner image using a toner which is frictionally charged negative (negative toner) in case of the fifth embodiment. A developer 4*e* contained in a developer container 4*a* is a two-component developer. Reference numeral 4*f* denotes a developer agitating member disposed on a bottom of the developer container 4*a* and reference numeral 4*g* denotes a toner hopper which contains a replenishing toner.

The two-component developer 4*e* contained in the developer container 4*a* is a mixture of a toner and a magnetic carrier, and is agitated by the developer agitating member 4*f*. In the fifth embodiment, the toner has an average particle diameter of 6 $\mu$m, whereas the magnetic carrier has resistance of approximately $10^{13}$ Ωcm and a particle diameter of approximately 40 $\mu$m. The toner is frictionally charged so as to have a negative polarity by friction with the magnetic carrier.

A developing sleeve 4*b* is disposed in the vicinity of the photosensitive drum 1 so as to oppose the photosensitive drum 1 with a shortest gap (referred to as S-D gap) of 350 $\mu$m reserved. Opposed portions of the photosensitive drum 1 and the developing sleeve 4*b* form a developing portion c. In the developing portion c, the developing sleeve 4*b* is rotatingly driven in a direction reverse to an advancing direction of the photosensitive drum 1. Due to a magnetic force of a magnet roller 4*c* disposed in the above described developing sleeve 4*b,* a portion of the two-component developer 4*e* contained in the developer container 4*a* is adsorbed and held on an outer circumferential surface of the sleeve as a magnetic brush layer, rotated and conveyed as the sleeve rotates, arranged into a predetermined thin layer by a developer coating blade 4*d,* brought into contact with the surface of the photosensitive drum 1 in the developing portion c and frictionally rubs the surface of the photosensitive drum appropriately. A predetermined developing bias voltage is applied to the developing sleeve 4*b* from a power supply S2.

The toner contained in the developer which is coated over the surface of the rotating developing sleeve 4*b* as the thin layer and conveyed to the developing portion c selectively adheres to the surface of the photosensitive drum 1 due to an electric field produced by the developing bias voltage in correspondence to an electrostatic latent image, whereby the electrostatic latent image is developed as a toner image. In case of the fifth embodiment, the toner adheres to an exposed bright portion of the surface of the photosensitive drum 1, whereby the electrostatic image is developed in reverse.

After passing through the developing portion c, the thin layer of the developer on the developing sleeve 4*b* is returned into a developer reservoir in the developer container 4*a* as the developing sleeve rotates successively.

In order to maintain a toner concentration of the two-component developer 4*e* in the developer container 4*a* within a predetermined nearly constant range, the toner concentration of the two-component developer 4*e* in the developer container 4*a* is detected, for example, with an optical concentration sensor (not shown) and the toner hopper 4*g* is drivingly controlled in accordance with detected information to replenish the two-component developer 4*e* in the developer container 4*a* with the toner from the toner hopper. The toner replenished to the two-component developer 4*e* is agitated by the agitating member 4*f*.

(2) Cleanerless system

The printer according to the fifth embodiment is cleanerless and does not comprise a cleaning device used exclusively for removing residual toner which remains in some amount on the surface of the photosensitive drum 1 after transferring the toner image to the transferring material P. The residual toner remaining after transferring on the surface of the photosensitive drum 1 is brought to the developing portion c through the electrifying portion a and the exposure portion b as the photosensitive drum 1 rotates successively, and subjected to simultaneous development-cleaning (recovery) by the developing device 4.

The simultaneous development-cleaning is a method which forms an electrostatic latent image by successively electrifying and exposing a photosensitive body at a next developing process and recovers a toner remaining after transferring on a portion of a surface of the photosensitive body which is not to be developed with the toner into a developing device by applying a fog removing bias voltage (a fog removing potential difference Vback which is a difference between a DC voltage to be applied to the developing device and a surface potential of the photosensitive body) at a developing process for the above described electrostatic latent image. This method allows the toner remaining after the transferring to be recovered into the developing device and used again for developing an electrostatic latent image at a next process, thereby making it possible to produce no waste toner and lessen a bother for maintenance. The cleanerless system is advantageous also for configuring an image forming apparatus more compact.

Reference numeral 8 denotes a toner electrification control device which is disposed downstream the transferring portion d in a rotating direction of the photosensitive drum and upstream the electrifying portion a in the rotating direction of the photosensitive drum. This toner electrification control device 8 is a brush-formed member (auxiliary brush) having appropriate electrical conductivity which is disposed with a brush portion kept in contact with the surface of the photosensitive drum 1 and to which a voltage having a negative polarity is applied from a power supply S4. Reference character f denotes a contact portion between the brush portion and the surface of the photosensitive drum 1. The toner remaining after the transferring on the photosensitive drum 1 which passes through the toner electrification control device 8 is electrified into the negative polarity which is the regular polarity.

The toner remaining after the transferring on the surface of the photosensitive drum 1 contains a negative toner which has not been transferred in the image portion, a fog toner having a positive polarity which has adhered to a non-image portion at the developing process and a toner whose polarity has been reversed to a positive polarity under an influence due to a transferring voltage having the positive polarity. Such a toner remaining after the transferring is uniformly electrified by the above described toner electrification control device 8 into the negative polarity. In the fifth embodiment, applied to the toner electrification control device 8 is −1000 V which is a voltage causing discharge to the photosensitive drum after the transferring. Accordingly, electric charges are imparted to the toner remaining by discharge and direct charge after the transferring while passing through the toner electrification control device 8, whereby the toner is uniformly electrified in the negative polarity.

At the above described electrification process, the surface of the photosensitive drum 1 is electrified from over the toner remaining after the transferring. Since the toner remaining after the transferring is uniformly electrified in the negative polarity, the toner does not adhere to the electrifying roller 2 to which a DC voltage having the negative polarity is applied. Though the photosensitive drum 1 is exposed from over the toner remaining after the transferring also at the exposure process, the toner remains in a small amount after the transferring and produces no remarkable influence. At the developing process, the toner remaining after the transferring on an unexposed portion of the photosensitive drum 1 is recovered into the developer container due to a relation between electric fields.

The shortest distance between the developing sleeve 4*b* and the photosensitive drum 1 (S-D gap) is 350 $\mu$m as described above and as far as this distance is maintained, the magnetic brush of the two-component developer which is formed on the developing sleeve 4*b* frictionally rubs the surface of the photosensitive drum 1 appropriately and the toner remaining after the transferring on the photosensitive drum 1 is recovered simultaneously with development. Furthermore, the developing sleeve 4*b* is rotated in the developing portion c in the direction reverse to the advancing direction of the photosensitive drum 1 so as to obtain an advantage for recovery of the toner remaining after the transferring.

(3) Control of peak to peak voltage of alternating voltage

Problems are posed when the AC electrification method is used in the cleanerless system. The problems are image flow and blur which are caused due to discharge products produced by AC electrification.

Also in case of the AC electrification method utilizing contact electrification, the AC electrification method produces ozone in an amount smaller than that of ozone produced by electrification with a corona electrifier and a discharge product produces more or less adverse influences. In an image forming apparatus, the discharge product adheres to a surface of a photosensitive body used as an image bearing body and resistance of the surface of the photosensitive body is lowered due to moisture absorption, thereby lowering resolution of a latent image, and in case of an image forming apparatus which adopts the above described cleanerless configuration, it cannot be expected that a cleaning device exhibits a photosensitive body renovating effect, thereby allowing blur, image flow or the like to be easily produced.

In order to obtain compatibility of solution of the above described problems with electrification uniformity, a desired amount of discharge current must always be obtained and it is necessary for this purpose to use an electrifying roller application voltage control device according to the present invention.

In the fifth embodiment, a peak to peak voltage of an alternating voltage is controlled as described below.

A peak to peak voltage to be applied at the print process is determined by applying peak to peak voltages to the electrifying roller 2 consecutively at three points in the discharge area and at three points in the undischarge area, and measuring alternating voltage values at the print preparation rotation operation process. A method to calculate the peak to peak voltage to be applied is similar to that described in the first embodiment.

The environment sensor 15 (FIG. 4) is disposed in the image forming apparatus main unit used in the fifth embodiment so that peak to peak voltages to be applied at the print preparation rotation operation process are variable dependently on environments, and in the H/H environment in which resistance of the electrifying roller is lower than that in the L/L environment, peak to peak voltages approximately 10% lower are applied. Accordingly, the fifth embodiment makes it possible to measure the alternating current at a voltage value which is close to that of a peak to peak voltage to be actually applied at the print process and obtain a desired amount of discharge current more securely.

Furthermore, the amount of discharge current D is also variable dependently on environments, and in the H/H environment in which an amount of discharge current required for obtaining electrification stability is lower and image flow is more liable to occur as compared with the L/L environment, an amount of discharge current is controlled to approximately ⅔ of the amount of discharge current D set in the L/L environment. Accordingly, the fifth embodiment makes it possible to securely prevent image flow and blur from being produced in the H/H environment, and perform stable and uniform electrification in the L/L environment without producing any sandy area.

By controlling the amount of the alternating current, it is possible to not only obtain effects similar to those of the first embodiment that the image forming apparatus absorbs manufacturing dispersion of an electrifying roller, fluctuations of a resistance value due to environmental changes of materials and high voltage dispersion of an apparatus main unit, and can obtain a desired amount of discharge current securely even when the electrifying roller is contaminated but also perform delicate control with a minimum amount of discharge current in various environments by performing an environment control simultaneously.

Accordingly, the fifth embodiment enables even a cleanerless image forming apparatus to stably provide images of high qualities for a long time without posing problems of image flow, improper electrification, fusing, image memory or the like.

<Sixth embodiment>

Figure 12:
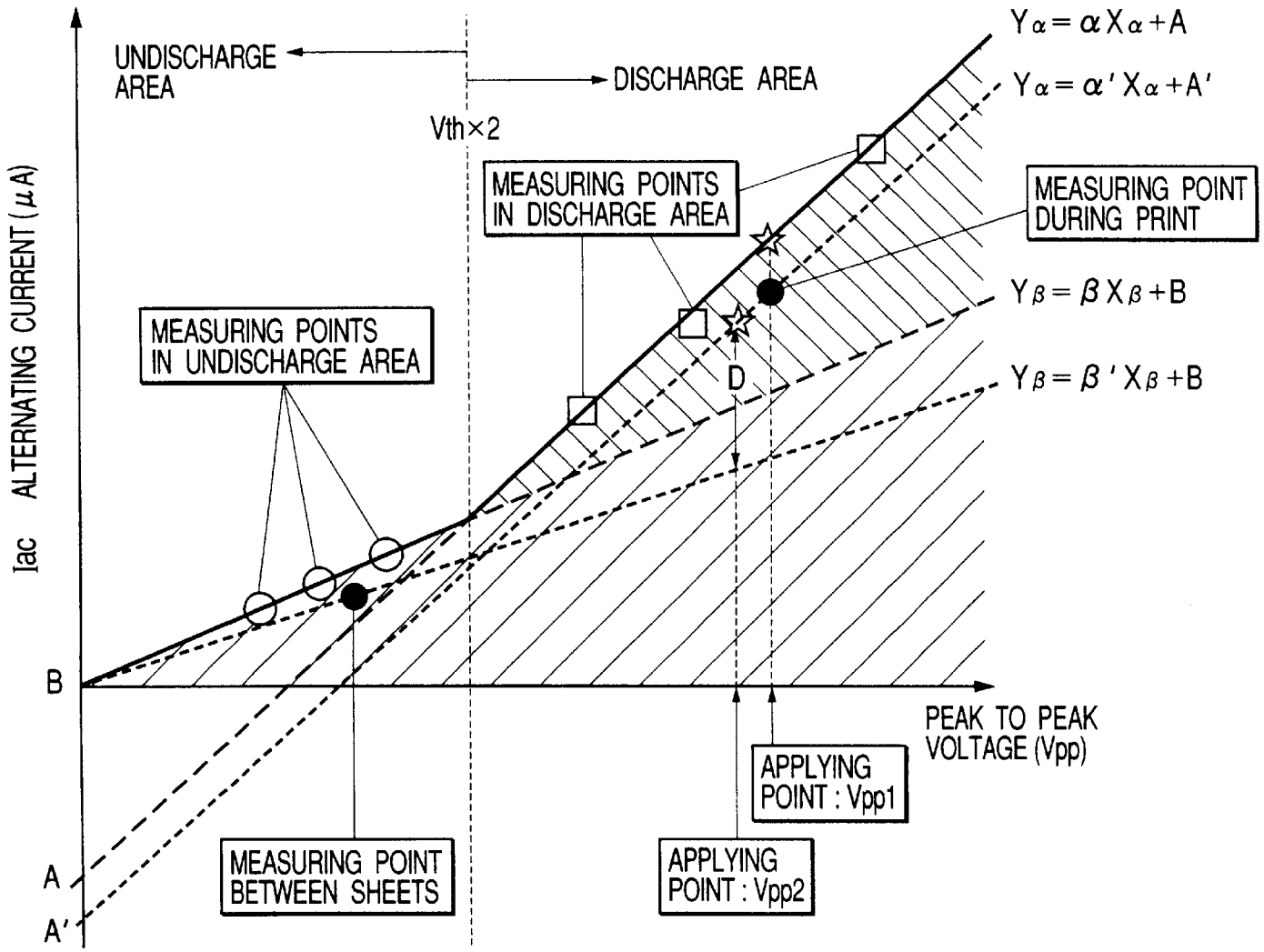
FIG. 12 is a diagram showing relations between peak to peak voltages and alternating current values to be measured during the print preparation rotation operation.
Figure 13:
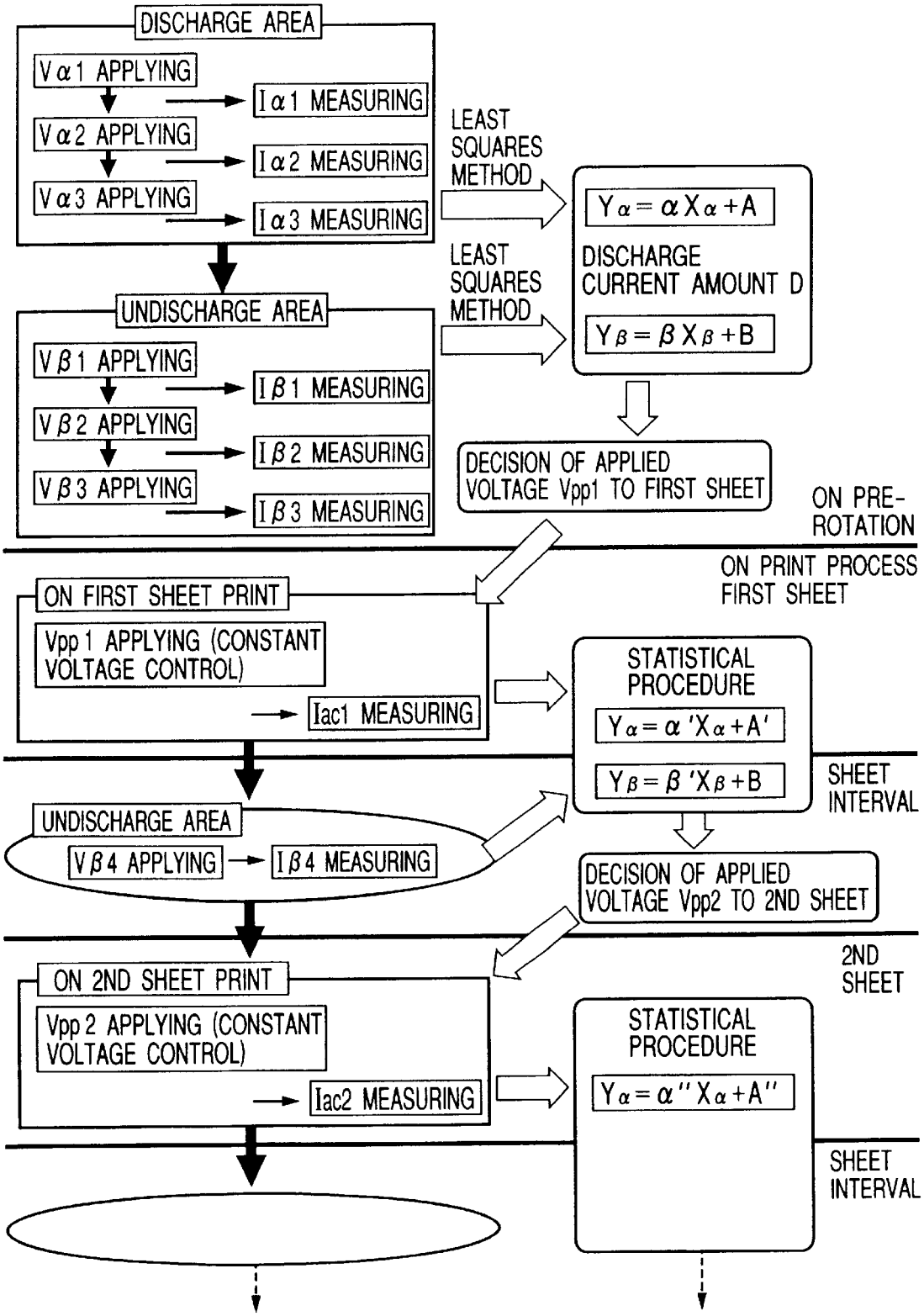
FIG. 13 is a diagram showing an electrification control sequence.

FIGS. 12 and 13 show still another embodiment of the present invention.

At the print preparation rotation operation process, a control circuit 13 controls an AC power supply 12 so that the power supply applies peak to peak voltages (Vpp) to an electrifying roller 2 consecutively at three points in a discharge area and at three points in an undischarge area, and alternating current values supplied to the electrifying roller 2 by way of a photosensitive body 1 at these points are measured with an alternating current value observation circuit 14 and input into the control circuit 13 as shown in FIG. 12.

From the current values measured at the above described three points, the control circuit 13 approximates a relation of the peak to peak voltages and the alternating currents in each of the discharge area and the undischarge area to a straight line using the least squares method, and calculates the following equations 2 and 3.

Equation 2 . . . Approximate straight line in discharge area:

$$Y_\alpha=\alpha X_\alpha+A$$

Equation 3 . . . Approximate straight line in undischarge area:

$$Y_\beta=\beta X_\beta+B$$

Then, the control circuit 13 determines a difference between the approximate straight line in the discharge area given by the formula 2 and the approximate straight line in the undischarge area given by the formula 3 as a peak to peak voltage Vpp which gives an amount of discharge current D according to a formula 4.

$$Vpp1=(D-A+B)/(\alpha-\beta) \qquad \text{Formula 4}$$

wherein a function fI1 (Vpp) and a function fI2 (Vpp) of peak to peak voltage (Vpp)-alternating current (Iac) in the undischarge area and the discharge area which are mentioned in the claim correspond to $Y_\beta=\beta X_\beta+B$ in the equation 3 and $Y_\alpha=\alpha X_\alpha+A$ in the equation 2 respectively. Furthermore, a constant D mentioned in the claim corresponds to the above described desired amount of discharge current D.

Hence, fI2 (Vpp)−fI1 (Vpp) described in the claim is:

$$Y_\alpha-Y_\beta=(\alpha X_\alpha+A)-(\beta X_\beta+B)=D$$

Furthermore, Vpp=(D−A+B)/(α−β) in the formula 4 is derived from fI2 (Vpp)−fI1 (Vpp)=D as follows:

$$fI2(Vpp)-fI1(Vpp)=Y_\alpha-Y_\beta=D$$

$$(\alpha X_\alpha+A)-(\beta X_\beta+B)=D$$

A point Vpp at which X has a searched value of D is:

$$(\alpha Vpp+A)-(\beta Vpp+B)=D$$

Hence, Vpp=(D−A+B)/(α−β

The control circuit 13 switches the peak to peak voltage to be applied to the electrifying roller 2 to Vpp1 determined according to the above described formula 4, controls a voltage to a constant level of Vpp1 and proceeds to the above described print process.

At the print process, the determined peak to peak voltage Vpp1 is applied to the electrifying roller 2, and an alternating current value supplied to the electrifying roller 2 at that current is measured by the alternating current value observation circuit 14 and input into the control circuit 13. Vpp1 is controlled to a constant voltage at this time.

In a non-image formation area between an image formation area and a next image formation area (sheet interval), the peak to peak voltage (Vpp) in the undischarge area is applied to the electrifying roller 2 at a point, and an alternating current value supplied at this time is measured by the alternating current value observation circuit 14 and input into the control circuit 13.

Formulae 5 and 6 which are mentioned below are calculated by performing a statistical processing from a newly measured relation between peak to peak voltages and alternating current values and the relation between the peak to peak values and the alternating current values which is measured at the print preparation rotation operation process. In other words, a measuring point at the print process and a measuring point at the sheet interval process are added to the measuring points determined by the control at the pre-rotation process to increase the number of measuring points for recalculation by the least squares method.

Formula 5 . . . Approximate straight line in discharge area:

$$Y_\alpha=\alpha' X_\alpha+A'$$

Formula 6 . . . Approximate straight line in undischarge are:

$$Y_\beta=\beta' X_\beta+B$$

Using a formula 7, the control circuit 13 determines a difference between the approximate straight line in the discharge area given by the formula 5 and the approximate straight line in the undischarge area given by the formula 6 as a peak to peak voltage Vpp2 which gives the amount of discharge current D similarly to the determination of the peak to peak voltage Vpp1 to be applied to the electrifying roller 2 at the print process.

$$Vpp2=(D-A'-B)/(\alpha'-\beta') \qquad \text{Formula 7}$$

wherein a function f1' (Vpp) and a function f2' (Vpp) of corrected peak to peak voltage (Vpp)-alternating current (Iac) in the undischarge area and the discharge area which are mentioned in the claim correspond to $Y_\beta=\beta' X_\beta+B$ in the above described formula 6 and $Y_\alpha=\alpha' X_\alpha+A'$ in the formula 2 respectively.

The formula 7 is derived from the functions FI1' (Vpp) and f2' (Vpp) as the formula 4 is derived from the above described functions f1 (Vpp) and f2 (Vpp).

The control circuit 13 switches the peak to peak voltage to be applied to the electrifying roller 2 to Vpp2 determined according to the above described formula 7 and then performs constant voltage control at Vpp2 for image formation.

At a next print process also, the control circuit 13 measures a relation between peak to peak voltages and alternating current values at the print process and the sheet interval process, and always corrects a peak to peak voltage to be applied to the electrifying roller 2 at the print process so long as a print operation is carried out.

The sixth embodiment calculates, at each print preparation rotation operation process, the peak to peak voltage which is required for obtaining the predetermined amount of discharge current D at the print process, applies the determined peak to peak voltage to the electrifying roller 2 while controlling the voltage to a constant voltage during the print process, and in a successive print mode, the sixth embodiment measures the alternating current value during the print process and the alternating current supplied when the peak to peak voltage (Vpp) in the undischarge area is applied to the electrifying roller 2 at the sheet interval process, and corrects a peak to peak voltage to be applied at the next print process.

Accordingly, the sixth embodiment not only absorbs manufacturing dispersion of the electrifying roller 2, resistance fluctation due to enviromental changes of materials, and high voltage dispersion in the apparatus main unit, but also makes it possible to securely obtain a desired amount of discharge current by performing correction for each sheet even when a resistance value of the electrifying roller 2 changes during successive prints.

Durability tests effected by this control method indicated no deterioration or cutting of the photosensitive drum 1 in any environment and proved that the control method makes it possible to prolong a service life of the photosensitive drum 1 approximately 15% as compared with the conventional constant current control method.

Though the sixth embodiment is configured to control the amount of discharge current by switching the peak to peak voltage of the alternating voltage to be applied to the electrifying roller 2, the present invention is not limited by the embodiment and it is possible to measure a peak to peak voltage of an alternating voltage by applying an alternating current (by modifying the alternating current value observation circuit 14 shown in FIG. 4 into a peak to peak voltage value observation circuit) and controlling an output alternating current from an AC power supply with the control circuit 13 so that an alternating current required for obtaining a desired amount of discharge current can always be applied at the print process.

Though the sixth embodiment is configured to apply a desired amount of discharge current D and a constant peak to peak voltage at the no-print process independently of environments, it is possible to perform uniform electrification more stably in the image forming apparatus which comprises the environment sensor (thermometer and hygrometer) 15 by changing a value of the peak to peak voltage dependently on environments.

Though the sixth embodiment is configured to measure the relations between the peak to peak voltages and the alternating currents (Vpp-Iac functions) in the discharge area and the undischarge area at the print process and the sheet interval process and correct the alternating voltage to be applied, the present invention is not limited by the embodiment and it is possible to perform only either of the measurement and the correction. In other words, it is also possible to measure an alternating current at an application time of the peak to peak voltage (Vpp) in the undischarge area at the sheet interval process and correct the alternating voltage to be applied to the electrifying roller 2 at the print process when the nip current changes remarkably with time or measure the alternating current and correct the alternating voltage to be applied at the print process when a discharge amount changes remarkably with time.

(1) When the alternating current is to be measured only at the print process

The Vpp-Iac function in the discharge area is corrected into $$Y_\alpha=\alpha' X_\alpha+A'$$

The Vpp-Iac function in the undischarge area is not corrected and remains as $$Y_\beta=\beta X_\beta+B$$

and a peak to peak voltage Vpp2 to be controlled to a constant level at the next print process is determined as $$Vpp2=(D-A'+B)/(\alpha'-\beta)$$

(2) When the alternating current is to be measured only at the sheet interval process The Vpp-Iac function in the discharge area is not corrected and remains as $$Y_\alpha=\alpha X_\alpha+A$$

The Vpp-Iac function in the undischarge area is corrected into $$Y_\beta=\beta' X_\beta+B$$

and a peak to peak voltage Vpp2 to be controlled to a constant level at the next print process is determined as $$Vpp2=(D-A+B)/(\alpha-\beta')$$

Accordingly, the sixth embodiment applies the peak to peak voltages to the electrifying roller 2 consecutively at the three points in the discharge area and at the three points in the undischarge area and measures the alternating voltage values at the print preparation rotation operation process, determines the peak to peak voltage (Vpp1) to be applied to the electrifying roller 2 at the print process, and in the successive print mode, the sixth embodiment measures the alternating current at the print process and the alternating current supplied when the peak to peak voltage in the undischarge area is applied at the sheet interval process and corrects the peak to peak voltage (Vpp2) to be applied to the electrifying roller 2 using measured values of the alternating currents at the next print process, thereby making it possible to always apply a peak to peak voltage giving the desired amount of discharge current D, obtain compatibility of prevention of deterioration and cutting of the photosensitive body with electrification uniformity, prolong a service life of the image forming apparatus and provide images of high qualities.

Furthermore, the sixth embodiment is capable of absorbing manufacturing dispersion and broadens ranges allowable for materials and precisions, thereby enabling to lower a manufacturing cost and provide inexpensive products to users.

<Seventh embodiment>

A seventh embodiment is a constant voltage control system for control at a point and description will be made of a method for determining a peak to peak voltage which gives an amount of discharge current D when a desired amount of discharge current is denoted by D.

An image forming apparatus applies peak to peak voltages (Vpp) to an electrifying roller consecutively at two points in a discharge area and at a point in an undischarge area and measures alternating current values at these points at the print preparation rotation operation process. A relation between the peak to peak voltages and the alternating currents is preliminarily set so that the alternating current value is zero when the peak to peak voltage is zero.

Using values measured at the two points in the discharge area and a measured value and a 0 point in the undischarge area, the image forming apparatus approximates relations between the peak to peak voltages and the alternating currents to straight lines, thereby calculating the following equations 2 and 3.

Equation 2 . . . Approximate straight line in discharge area:

$$Y_\alpha=\alpha X_\alpha+A$$

Equation 3 . . . Approximate straight line in undischarge area:

$$Y_\beta=\beta X_\beta$$

Then, the image forming apparatus determines a difference between the approximate straight line $Y_\alpha$ in the discharge area and the approximate straight line $Y_\beta$ in the undischarge area as a peak to peak voltage Vpp which gives the amount of discharge current D according to a formula 4.

$$Vpp=(D-A)/(\alpha-\beta) \qquad \text{Formula 4}$$

The image forming apparatus switches a peak to peak voltage to be applied to the electrifying member to determined Vpp1, controls this voltage to a constant level and proceeds to the above described image formation process.

At the image formation process, the image forming apparatus applies the determined peak to peak voltage Vpp1 while controlling the voltage to a constant level and measures an alternating current value which is supplied to the electrifying roller at this time.

The image forming apparatus applies the peak to peak voltage (Vpp) in the undischarge area to the electrifying roller at a point in a no-image formation area between an image formation area and a next image formation area (sheet interval process) and measures an alternating current value supplied at this time.

From a relation between a newly measured peak to peak voltage and an alternating current value and the relation between the peak to peak values and the alternating current values which is measured at the print preparation rotation operation process, the image forming apparatus calculates formulae 5 and 6 mentioned below through a statistical processing.

Formula 5 . . . Approximate straight line in discharge area:

$$Y_\alpha=\alpha' X_\alpha+A'$$

Formula 6 . . . Approximate straight line in undischarge are:

$$Y_\beta=\beta' X_\beta$$

Then, the image forming apparatus determines a difference between the approximate straight line $Y_\alpha$ in the discharge area and the approximate straight line $Y_\beta$ in the undischarge area as the peak to peak voltage Vpp2 which gives the amount of discharge current D using a formula 7 similarly to determination of the peak to peak voltage Vpp1 to be applied at the print process.

$$Vpp=(a-A)/(\alpha'-\beta') \quad \text{Formula 7}$$

Then, the image forming apparatus switches the voltage to be applied to the electrifying roller to the voltage Vpp2 and controls the voltage to a constant level for image formation.

At a next image formation process also, the image forming apparatus similarly measures relations between peak to peak voltages and alternating currents at the print process and the sheet interval process, and corrects the peak to peak voltage to be applied while an image forming operation is carried out.

When zero points are matched between a peak to peak voltage and an alternating current, it is possible to control a measurement at a point in an undischarge area to shorten a measuring time.

<Eighth embodiment>

An eighth embodiment is a constant current control system for control at three points and description will be made of a method for determining an alternating current value which gives an amount of discharge current D when a desired amount of discharge current is denoted by D.

An image forming apparatus applies alternating currents (Iac) to an electrifying roller consecutively at three points in a discharge area and at three points in an undischarge area and measures peak to peak voltages at these points at the print preparation rotation operation process.

From current values measured at the three points, the image forming apparatus approximates a relation between the peak to peak voltages and the alternating currents (Vpp-Iac function) in each of the discharge area and the undischarge area to a straight line using the least squares method, thereby calculating the following equations 2 and 3.

Equation 2 . . . Approximate straight line in discharge area:

$$Y_\alpha=\alpha X_\alpha+A$$

Equation 3 . . . Approximate straight line in undischarge area:

$$Y_\beta=\beta X+B$$

Then, the image forming apparatus determines a difference between the approximate straight line $Y_\alpha$ in the discharge area and the approximate straight line $Y_\beta$ in the undischarge area as an alternating current (Iac) which gives the amount of discharge current D according to a formula 4.

When an alternating current value which gives D is denoted by Iac1 and a peak to peak voltage at this alternating current value is denoted by Vpp, the equation 2 and the equation 3 are $$Iac1=\alpha Vpp+A \quad \text{formula a}$$

$$Iac2=\beta Vpp+B \quad \text{formula b}$$

wherein Iac2 is an alternating current value which gives Vpp on the approximate straight line $Y_\beta$ in the undischarge area.

$$Iac1=Iac2+D \quad \text{formula c}$$

From the formulae a, b and c, the alternating current (Iac1) which gives the amount of discharge current D is determined according to the formula 4.

$$Iac1=(\alpha D+\alpha B-\beta A)/(\alpha-\beta) \quad \text{Formula 4}$$

The image forming apparatus switches the alternating current to be applied to an electrifying member to determined Iac1, controls the current to a constant level of Iac1 and proceeds to the above described image forming operation process.

At the image formation process, the image forming apparatus applies the determined alternating current Iac1 and measures a peak to peak voltage at the alternating current.

The image forming apparatus applies the alternating current in the undischarge area to the electrifying roller at a point in a non-image formation area between an image formation area and a next image formation area (at a sheet interval process) and measures a peak to peak voltage at this point.

From a relation between a newly measured peak to peak voltage and an alternating current value and the relation between the peak to peak voltages and the alternating current values measured at the print preparation rotation operation process, the image forming apparatus calculates the following equations 5 and 6 through statistical processing.

Equation 5 . . . Approximate straight line in discharge area:

$$Y_\alpha=\alpha' X_\alpha+A'$$

Equation 6 . . . Approximate straight line in undischarge area:

$$Y_\beta=\beta' X_\beta+B$$

Using a formula 7, the image forming apparatus determines a difference between the approximate straight line $Y_\alpha$ in the discharge area and the approximate straight line $Y_\beta$ in the undischarge area as an alternating current Iac3 which gives the amount of discharge current D similarly to the determination of the alternating current Iac1 to be applied at the print process.

$$Iac3=(\alpha' D+\alpha' B-\beta' A')/(\alpha'-\beta') \quad \text{Formula 7}$$

The image forming apparatus switches the alternating current to be applied to the electrifying roller to Iac3, controls the current to a constant level of Iac3 for image formation.

At a next image formation process also, the image forming apparatus measures relations between peak to peak voltages and alternating current values at the print process and the sheet interval process, and corrects an alternating current to be applied so long as an image forming operation is carried out.

Though the eighth embodiment is configured to measure the relation between the peak to peak voltages and the alternating currents (Vpp-Iac function) in each of the discharge area and the undischarge area at the print process and the sheet interval process, the present invention is not limited by the embodiment and the relation may be measured only at either of the processes.

(1) When the alternating current is to be measured at the print process

The Vpp-Iac function in the discharge area is corrected into $$Y_\alpha=\alpha' X_\alpha+A'$$

The Vpp-Iac function in the undischarge area is not corrected and remains as $$Y_\beta=\beta X_\beta+B$$

and a peak to peak voltage Vpp2 to be controlled to a constant level at a next print process is determined as described below.

$$Iac3=(\alpha' D+\alpha' B-\beta A')/(\alpha'-\beta)$$

(2) When the alternating current is to be measured only at the sheet interval process The Vpp-Iac function in the discharge area is not corrected and remains as $$Y_\alpha=\alpha X_\alpha+A$$

The Vpp-Iac function in the undischarge area is corrected into $$Y_\beta=\beta' X_\beta+B$$

and a peak to peak voltage Vpp2 to be controlled to a constant level at a next print process is determined as described below.

$$Iac3=(\alpha D+\alpha B-\beta' A)/(\alpha-\beta')$$

<Ninth embodiment>

A ninth embodiment is a constant current control system for control at a point and description will be made of a method for determining an alternating current value which gives an amount of discharge current D taking a desired amount of discharge current as D.

An image forming apparatus applies to an electrifying roller alternating currents (Iac) consecutively at two points in a discharge area and at a point in an undischarge area at the print preparation rotation operation process, and measures peak to peak voltages at these points. A relation between the peak to peak voltages and the alternating currents is preliminarily set so that an alternating current value is zero when the peak to peak voltage is zero.

Using values measured at the two points in the discharge area and a measured value and a 0 point in the undischarge area, the image forming apparatus approximates relations between the peak to peak voltages and the alternating currents to straight lines, thereby calculating the following equations 2 and 3.

Equation 2 . . . Approximate line in discharge area:

$$Y_\alpha=\alpha X_\alpha+A$$

Equation 3 . . . Approximate line in undischarge area:

$$Y_\beta=\beta X_\beta$$

Then, the image forming apparatus determines a difference between the approximate straight line $Y_\alpha$ in the discharge area and the approximate straight line $Y_\beta$ in the undischarge area as an alternating current (Iac) which gives the amount of discharge current D according to a formula 4.

When an alternating current value which gives D is represented by Iac1 and a peak to peak voltage at the alternating current value is denoted by Vpp, the equations 2 and 3 are:

$$Iac1=\alpha Vpp+A \qquad \text{formula a}$$

$$Iac2=\beta Vpp \qquad \text{formula b}$$

wherein Iac2 is an alternating current value which gives Vpp on the approximate straight line $Y_\beta$ in the undischarge area.

$$Iac1-Iac2=D \qquad \text{formula c}$$

From the formulae a, b and c, the alternating current (Iac) which gives the amount of discharge current D is determined according to the formula 4.

$$Iac=(\alpha D-\beta A)/(\alpha-\beta) \qquad \text{Formula 4}$$

The image forming apparatus switches an alternating current to be applied to an electrifying member to the determined Iac, controls a current to a constant level of Iac and proceeds to the above described image forming operation process.

The image formation process, the image forming apparatus applies Iac1 determined from the alternating current determined above and measures a peak to peak voltage at the alternating current.

The image forming apparatus applies the alternating current in the undischarge area to an electrifying roller at a point in a no-image formation area between an image formation area and a next image formation area (sheet interval) and measures a peak to peak voltage at this point.

From a relation between newly measured peak to peak voltage and alternating currents and the relation between the peak to peak voltages measured at the print preparation rotation operation process, the image forming apparatus calculates the following equations 5 and 6 through statistic processing.

Equation 5 . . . Approximate straight line in discharge area:

$$Y_\alpha=\alpha' X_\alpha+A'$$

Equation 6 . . . Approximate straight line in undischarge area:

$$Y_\beta=\beta' X_\beta+B$$

Using a formula 7, the image forming apparatus determines an alternating current Iac3 at which the amount of discharge current D is a difference between the approximate straight line $Y_\alpha$ in the discharge area and the approximate straight line $Y_\beta$ in the undischarge area similarly to the determination of the alternating current Iac1 to be applied at the print process.

$$Iac3=(\alpha' D-\beta A')/(\alpha'-\beta) \quad \text{Formula 7}$$

The image forming apparatus switches a alternating current Iac3 to be applied to the electrifying roller to, controls a current to a constant level of Iac3 and forms images.

At a next image forming process also, the image forming apparatus similarly measures relations between peak to peak voltages and alternating currents at a printing time and a sheet interval, and always corrects an alternating current to be applied so long as an image forming operation is carried out.

Owing to this control, the ninth embodiment is capable of obtaining effects similar to those of the first through third embodiments. Furthermore, the ninth embodiment has a smaller number of measuring points and is capable of shortening a preparation rotation time.

<Tenth embodiment>

Figure 14:
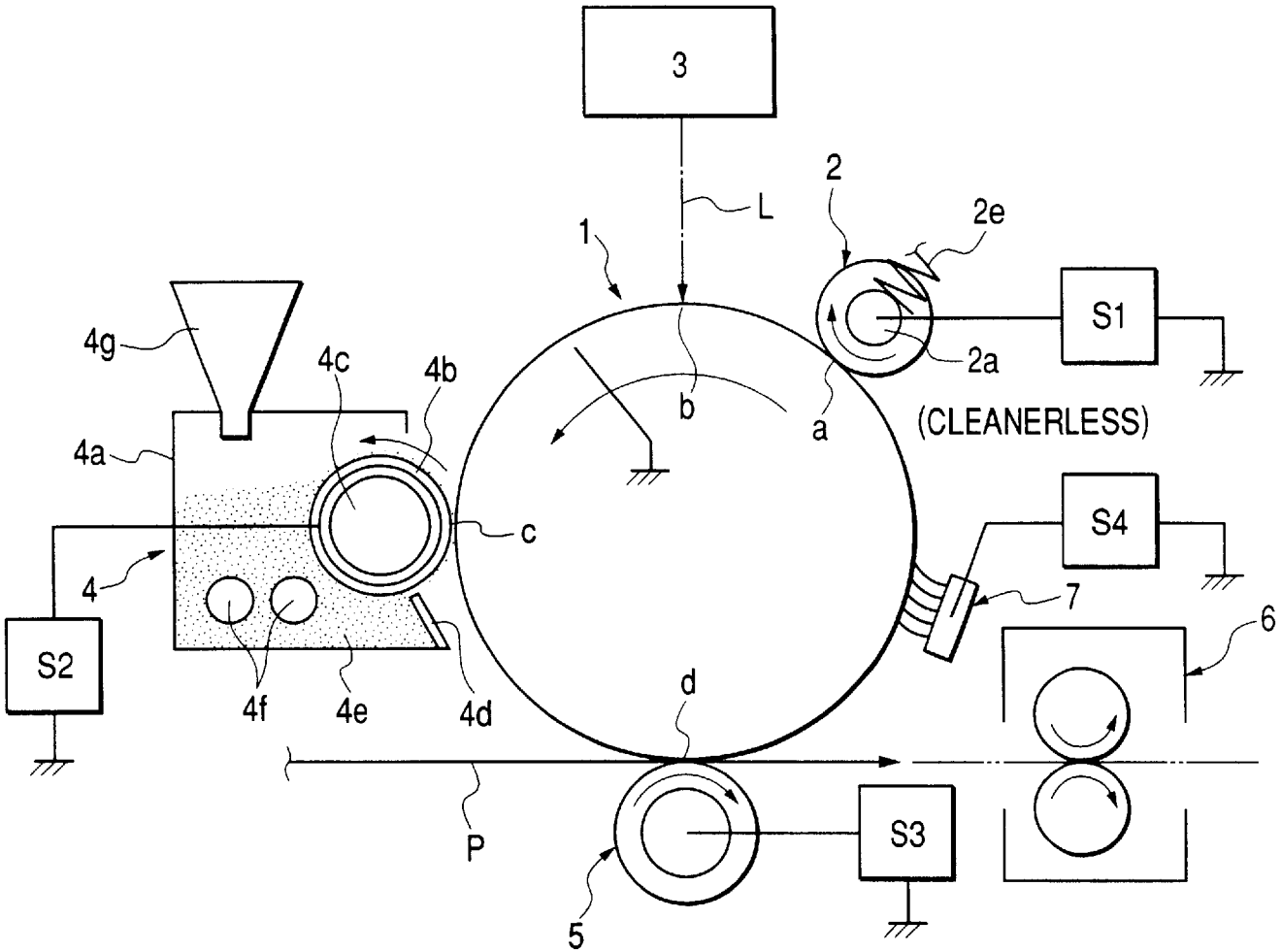
FIG. 14 is a schematic configurational diagram of an image forming apparatus (cleanerless) according to an embodiment.

FIG. 14 is a schematic configurational diagram showing an embodiment of the image forming apparatus according to the present invention. An image forming apparatus according to a tenth embodiment is a contact electrification, reversal development type cleanerless laser beam printer which utilizes a transferring electrophotographic process and has a maximum sheet passage size of A3.

(1) Overall configuration of printer a) Image bearing body

Reference numeral 1 denotes a rotating drum type electrophotographic photosensitive body (hereinafter referred to as a photosensitive drum) used as an image bearing body. This photosensitive drum 1 is a negatively chargeable organic photoconductive body which has an outside diameter of 50 mm and is rotatingly driven around a center support shaft in a counterclockwise direction indicated by an arrow at a process speed (peripheral speed) of 100 mm/sec.

This photosensitive drum 1 has a configuration where three layers of a base layer 1*b* for suppressing interference of rays and enhancing adhesion of an upper layer, a photoelectric charge generating layer 1*c* and an electric charge transporting layer 1*d* which are coated in an order from a downside over a surface of an aluminium cylinder (electrically conductive drum substrate) 1*a* as layer configurational diagram shown in FIG. 2.

b) Electrifying device

Reference numeral 2 denotes a contact electrifying device (contact electrifier) used as a device for uniformly electrifying a circumferential surface of the photosensitive drum 1, which is an electrifying roller (roller electrifier) in the tenth embodiment.

This electrifying roller 2 has a core metal 2*a* whose both ends are rotatably held by bearing members (not shown), and is urged by a push spring 2*e* toward the photosensitive drum, kept in contact with a surface of the photosensitive drum 1 under a predetermined pressure and rotated while following a rotation of the photosensitive drum 1. Portions of the photosensitive drum 1 and the electrifying roller 2 which are kept in contact under the pressure constitutes an electrifying portion (electrifying nip portion) a.

An electrifying bias voltage in a predetermined condition is applied from a power supply 1 to the core metal 2*a* of the electrifying roller 2 and the circumferential surface of the rotating photosensitive drum 1 is uniformly electrified so as to have a negative polarity in the tenth embodiment.

A configuration, an electrifying condition, an electrification control method or the like of the above described electrifying roller 2 will be described in detail in section (2).

c) Information write device

Reference numeral 3 denotes an exposure device provided as information write device for forming an electrostatic latent image on the surface of the electrified photosensitive drum 1, which is a laser beam scanner in the tenth embodiment. Laser scanning exposure L of the uniformly electrified surface of the rotating photosensitive drum 1 is performed at an exposure portion b by outputting a laser beam which is modulated in correspondence to an image signal sent from a host apparatus such as an image reading apparatus which is not shown to a side of the printer. This laser scanning exposure L causes a potential drop on a portion of the surface of the photosensitive drum 1, whereby electrostatic latent images corresponding to scanned and exposed image information is consecutively formed on the surface of the rotating photosensitive drum 1.

d) Developing device

Reference numeral 4 denotes a developing apparatus (developing device) functioning as a device for visualizing an electrostatic latent image by supplying a developing agent (toner) to the electrostatic latent images on the photosensitive drum 1, which is a two-component magnetic brush developing type reversal developing apparatus in the tenth embodiment, and the electrostatic latent images formed on the surface of the photosensitive drum 1 are consecutively developed by this developing apparatus 4 as toner images with a toner frictionally charged negatively in the tenth embodiment.

Reference numeral 4*a* denotes a developer container and reference numeral 4*b* denotes a non-magnetic developing sleeve which is rotatably disposed in the developing container 4*a* with a portion of an outer circumferential exposed. Reference numeral 4*c* denotes a magnet roller which is inserted into the developing sleeve 4*b* and fixed so as not to rotate, reference numeral 4*d* denotes a developer coating blade, reference numeral 4*e* denotes a two-component developer contained in the developer container 4*a*, reference numeral 4*f* denotes a developer agitating member arranged on a bottom of the developer container 4*a* and reference numeral 4*g* denotes a toner hopper containing a replenishing toner.

The two-component developer 4*e* contained in the developer container 4*a* is a mixture of a toner and a magnetic carrier, and is agitated by the developer agitating member 4*f*. In the tenth embodiment, the magnetic carrier has resistance of approximately $10^{13}$ Ωcm and an average particle diameter of approximately 40 μm. The toner is frictionally rubbed by the magnetic carrier and electrified in a negative polarity.

The developing sleeve 4*b* is disposed in the vicinity of the photosensitive drum 1 so as to oppose to the drum with a shortest distance (referred to as S-D gap) of 350 μm reserved. Portions of the photosensitive drum 1 and the developing sleeve 4*b* which are opposed to each other constitutes a developing portion c. In the developing portion c, the developing sleeve 4*b* is rotatingly driven in a direction reverse to an advancing direction of the photosensitive drum 1. A portion of the two-component developer 4*e* is adsorbed from the developer container 4*a* and held as a magnetic brush layer on an outer circumferential surface of the developing sleeve 4*b* by a magnetic force of the magnet roller 4*c* in the sleeve, shaped in a predetermined thin layer by the developer coating blade 4*d* and brought into contact with the surface of the photosensitive drum 1 in the developing portion c, thereby appropriately rubs the surface of the photosensitive drum frictionally. A predetermined developing bias voltage is supplied to the developing sleeve 4*b* from a power supply S2.

The toner component contained in the developer which has been coated over the surface of the rotating developing sleeve 4*b* and conveyed into the developing portion c adheres selectively to the surface of the photosensitive drum 1 in correspondence to the electrostatic latent images, whereby the electrostatic latent images are developed in reverse as toner images. According to this example, the toner adheres to a bright exposure part of the surface of the photosensitive drum 1, and consequently the electrostatic latent images are reversed and developed.

The toner layer of the developer on the developing sleeve 44 which has passed through the developing portion c is returned into a developer reservoir in the developer container 4*a* as the developing sleeve rotates successively.

In order to maintain a toner concentration of the two-component developer 4*e* in the developer container 4*a* within an approximate constant given range, the toner concentration of the two-component developer 4*e* in the developer container 4*a* is detected, for example, with an optical toner concentration sensor (not shown) and the toner hopper 4*g* is drivingly controlled according to detection information, thereby the toner is replenished from the toner hopper to the two-component developer 4*e* in the developer container 4*a*. The toner which has been replenished to the two-component developer 4*e* is agitated by the agitating member 4*f*.

e) Transferring device and fixing device

Reference numeral 5 denotes a transferring device, which is a transferring roller in the tenth embodiment. This transferring roller 5 is kept in contact with the photosensitive drum 1 with a predetermined pressing force, and a pressure contact nip portion between the transferring roller 5 and the photosensitive drum 1 is a transferring portion d. A transferring material (transferring member or recording material) P is fed to the transferring portion d from a sheet feeding mechanism section (not shown) with a predetermined controlled timing.

The transferring material P fed to the transferring portion d is sandwiched and conveyed between the photosensitive drum 1 and the transferring roller 5, and in this wile, a transferring bias voltage having a positive polarity reverse to the regular negative polarity is applied to the transferring roller 5 from a power supply S3, whereby the toner images transferred consecutively from the surface of the photosensitive drum 1 to a surface of the transferring material P in which the transferring portion d is sandwiched and conveyed.

The transferring material P which has passed through the transferring portion d and to which the toner images have been transferred is consecutively separated from the surface of the photosensitive drum 1, conveyed to a fixing apparatus 6 (for example, a heat roller fixing apparatus), subjected to fixing treatment of the toner images and output as an article on which images are formed (a print or a copy).

f) Cleanerless

The printer according to the tenth embodiment is cleanerless type which has no cleaning device used exclusively to remove the toner remaining more or less on the surface of the photosensitive drum 1 after transferring the toner images to the transferring material P. The toner remaining after the transferring on the surface of the photosensitive drum 1 is brought into the developing portion c through the electrifying portion a and the exposure portion b as the photosensitive drum 1 rotates successively and cleaned (recovered) simultaneously with the development with the developing apparatus 4 (cleanerless system).

Since the toner remaining after the transferring on the surface of the photosensitive drum 1 passes through the exposure portion 6, the exposure process is performed over the toner remaining after the transferring, but the toner remains in a small amount and produces no remarkable influence.

Reference numeral 7 denotes a toner electrification control device which is disposed downstream the transferring portion d in a rotating direction of the photosensitive drum and upstream the electrifying portion a in the rotating direction of the photosensitive drum. This toner electrification control device 7 is a brush-shaped member having appropriate electrical conductivity and a brush portion kept in contact with the surface of the photosensitive drum 1, and a voltage having a negative polarity is applied from a power supply S4 to the toner electrification control device 7. Reference character e denotes a contact portion between the brush portion and the surface of the photosensitive drum 1. A charged polarity of the toner remaining after the transferring on the photosensitive drum 1 is regularized into the negative polarity while passing by the toner electrification control device 7. Specifically, the toner remaining after the transferring on the surface of the photosensitive drum 1 contains a toner having the negative polarity in the image area, a toner having the positive polarity in the non-image area and a toner having a polarity reversed to the positive polarity under an influence due to the transferring voltage having the positive polarity. The toner remaining after the transferring is uniformly electrified into the negative polarity by the above described toner electrification control device 7 and brought to the developing portion c through the electrifying portion a without adhering to the electrifying roller 2, whereby the toner remaining after the transferring on a portion of the photosensitive drum 1 which should not to be developed with the toner is recovered into the developing apparatus 4 owing to a relation between electric fields.

(2) Detained description of electrifying device

Figure 15:
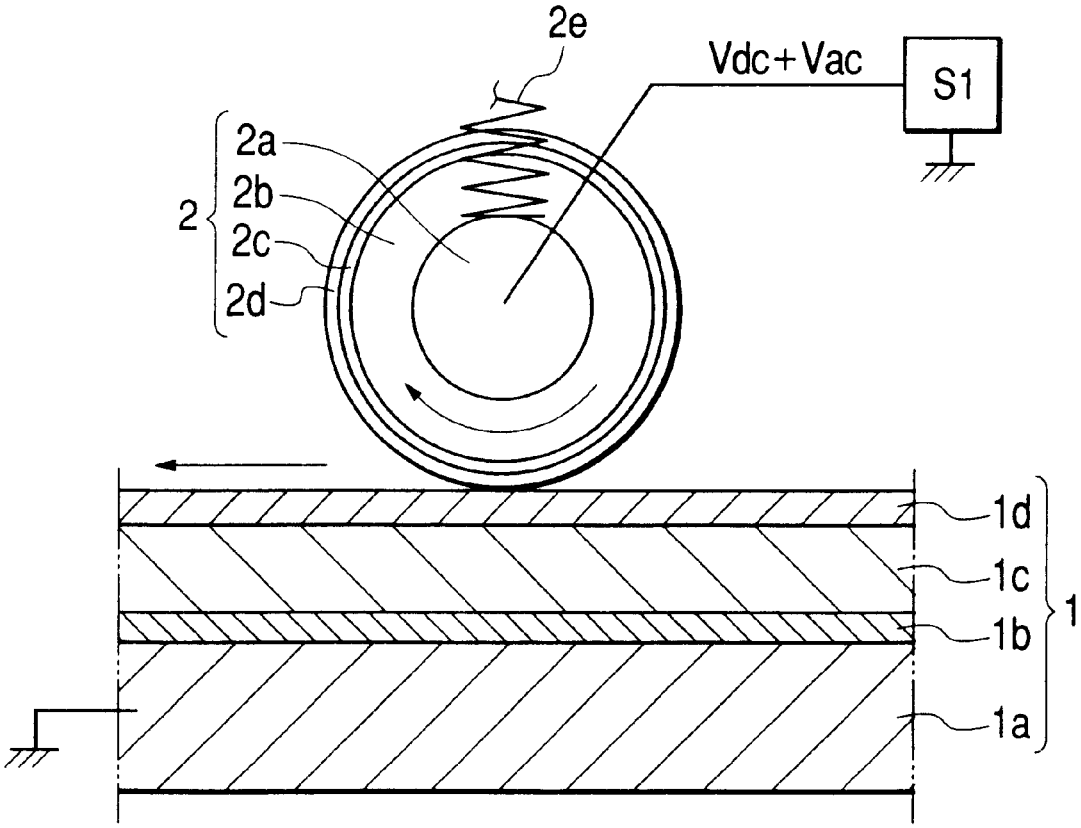
FIG. 15 is a diagram showing layer configurations of a photosensitive body drum and an electrifying roller.

The electrifying roller 2 provided as the contact electrifying member has a longitudinal length of 320 mm and a three-layer configuration consisting of a lower layer 2*b*, an intermediate layer 2*c* and a surface layer 2*d* from the bottom which are laminated consecutively around a core metal (support member) as layer configurational diagram shown in FIG. 15. The lower layer 2*b* is a expanded sponge layer for lowering an electrifying sound, the intermediate layer 2*c* is an electrically conductive layer for unformalizing resistance throughout the electrifying roller and the surface layer 2*d* is a protective layer for preventing leak from occurring regardless of defects such as pinholes in the photosensitive drum 1.

More specifically, the electrifying roller 2 used in the tenth embodiment has specifications described below.

Core metal 2*a:* Stainless steel round bar having a diameter of 6 mm

Lower layer 2*b:* Expanded EPDM containing dispersed carbon, specific weight 0.5 g/cm$^3$, volume resistance $10^2$ to $10^9$ Ωcm, thickness 3.0 mm, length 320 mm Intermediate layer 2*c:* NBR-based rubber containing dispersed carbon, volume resistance $10^2$ to $10^5$ Ωcm, thickness 700 μm Surface layer 2*d:* Toresin resin of fluorine compound containing dispersed tin oxide and carbon, volume resistance $10^7$ to $10^{10}$ Ωcm, (mean surface roughness Ra) 1.5 μm, thickness 10 μm.

The circumferential surface of the rotating photosensitive drum 1 is electrified to a predetermined potential by applying a predetermined oscillating voltage (bias voltage Vdc+Vac) which consists of a DC voltage and an AC voltage having a frequency of 1000 Hz overlapped with the DC voltage from the power supply S1 to the electrifying roller 2 by way of the core metal 2*a*.

Figure 16:
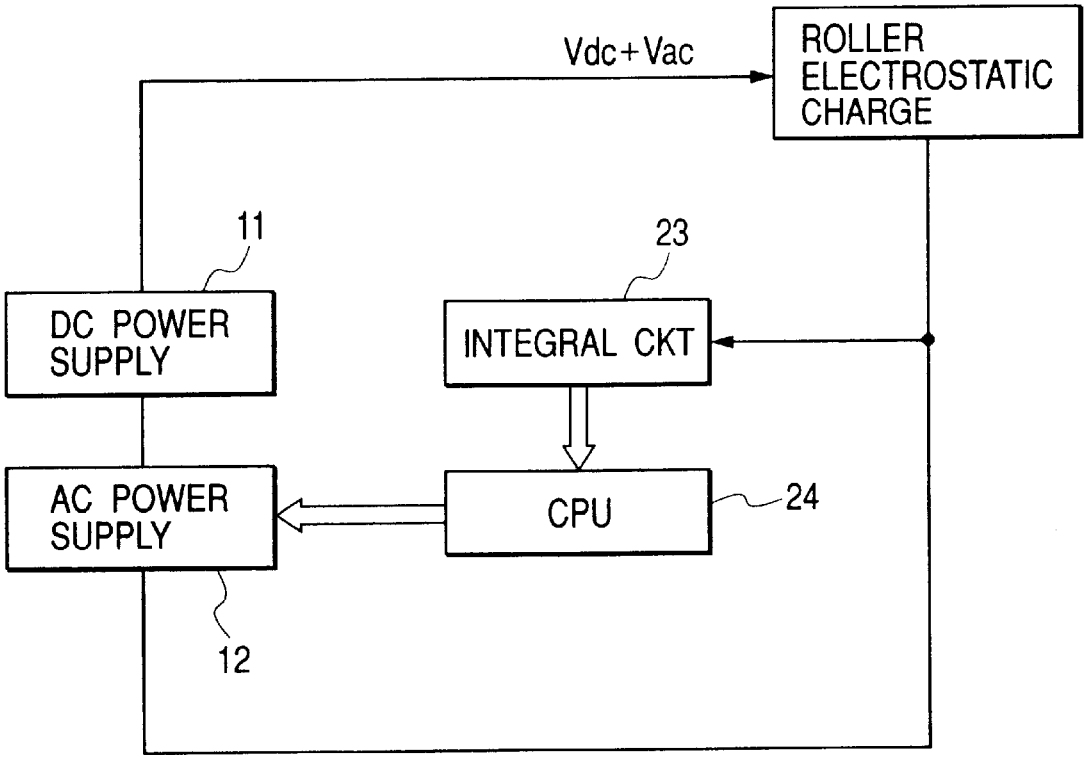
FIG. 16 is a block circuit diagram of a power supply apparatus.

Description will now be made of a manner of controlling at the electrifying process. FIG. 16 is a block diagram of a power supply circuit for applying the oscillating voltage to the electrifying roller 2. Reference numeral 11 denotes a DC power supply, reference numeral 12 denotes an AC power supply, and the oscillating voltage Vdc+Vac consisting of a DC voltage Vdc output from the DC power supply 11 and an AC voltage Vac output from the AC power supply 12 and overlapped with the DC voltage is applied to the electrifying roller 2. Reference numeral 23 denotes an integral circuit which is used as a device for measuring an integral value of a current waveform supplied to the electrifying roller 2. Reference numeral 24 denotes a CPU adopted as a control circuit.

In this power supply circuit, the AC power supply 11 generates the AC voltage Vac having a sine wave at the frequency of 1000 Hz and an AC voltage component at this time, that is, a peak to peak voltage is subjected to a feedback control so that a constant integral value is obtained by converting an AC current waveform with the integral circuit 13. In other words, a voltage to be applied to the electrifying roller 2 is output so that an integral value of the current waveform is constant in a unit time.

An integral calculation is performed by an integral circuit 23 in the tenth embodiment and the integral value is output as a DC voltage, which is subjected to AD conversion and output to a CPU 24.

Figure 17A:
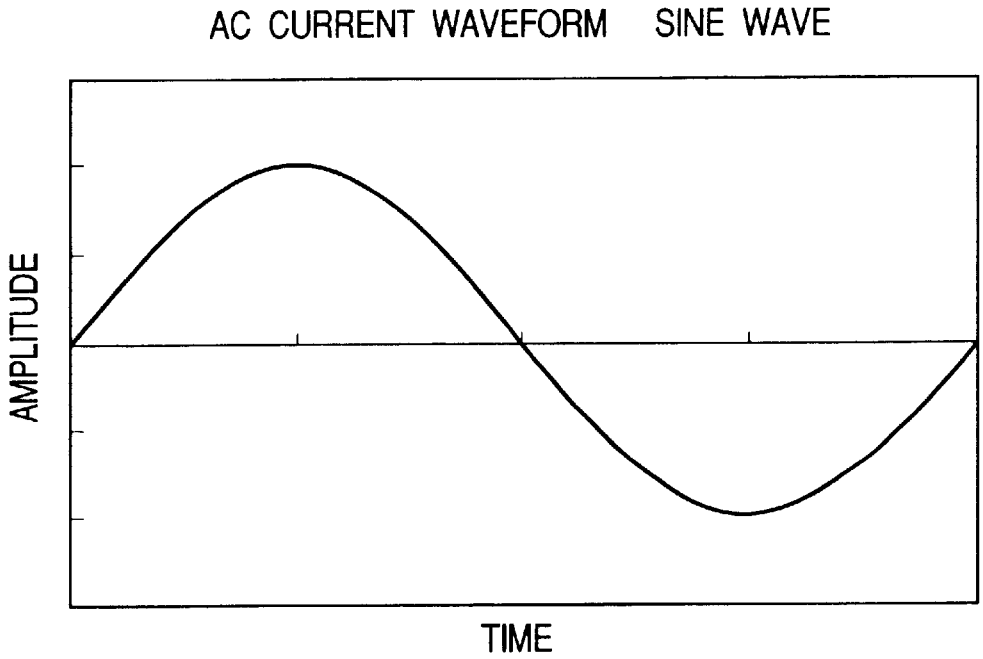
FIGS. 17A and 17B are diagrams showing an alternating current waveform (sine wave) and an alternating current waveform (use of an absolute value circuit) respectively.
Figure 17B:
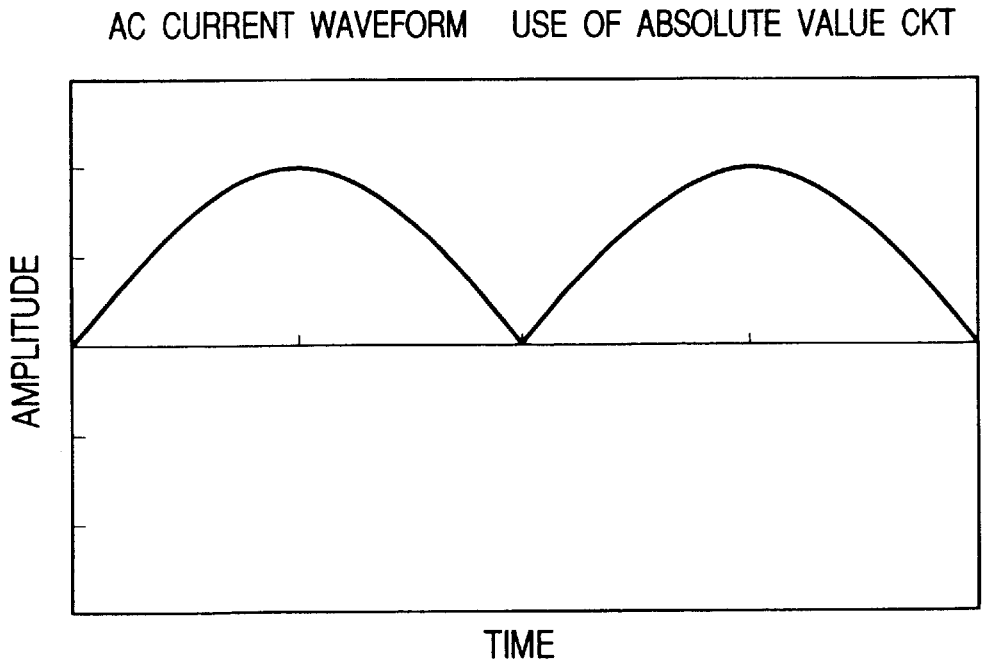

Description will now be made of a method of integration. In a case where the AC current waveform is a sine wave as shown in FIG. 17A, integration of the waveform for a period gives zero when signs of amplitude values are included. Using an absolute value circuit, the current waveform is once converted into a waveform which has amplitudes in absolute values as shown in FIG. 17B and the absolute values of the current waveform are integrated. Alternately, the waveform may be integrated for half a period.

Description will be made here of a waveform of a current supplied to the electrifying roller 2 in the configuration of the tenth embodiment.

It is known, as disclosed by Japanese Patent Application Laid-Open No. 63-149668, that Vd+Vth (a discharge start voltage) is necessary to obtain a desired potential Vd on a surface of a photosensitive body when a DC voltage is applied to an electrifying roller and in case of a voltage with which an AC voltage component is overlapped, a DC voltage corresponding to the desired potential Vd and a peak to peak voltage twice or more as high are necessary.

Figure 18A:
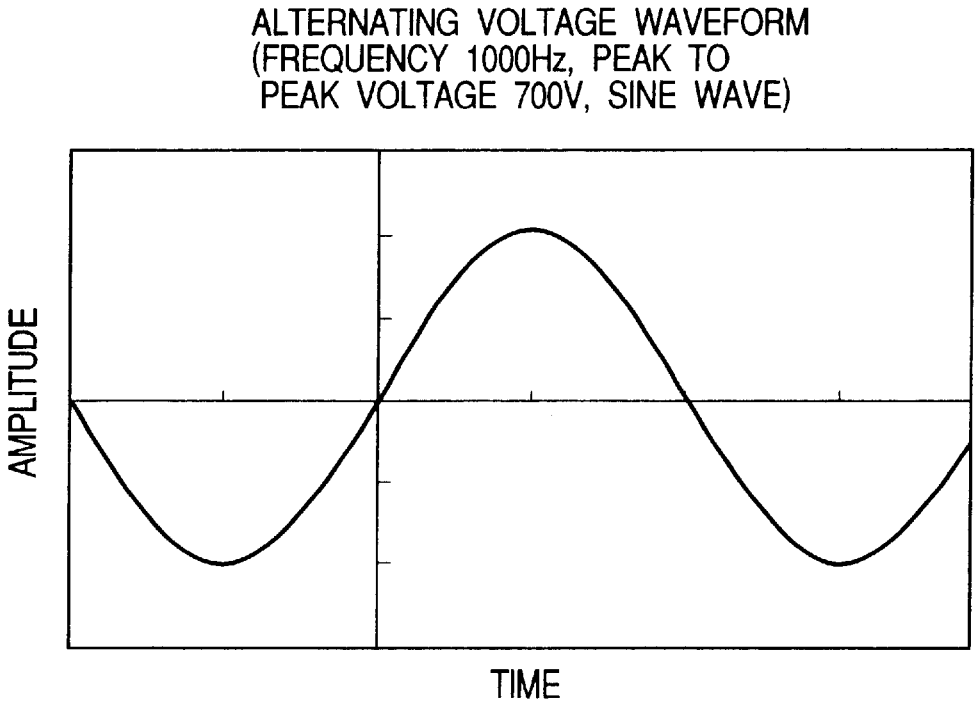
FIGS. 18A and 18B are diagrams showing an alternating voltage waveform (frequency 1000 Hz, peak to peak voltage 700 V, sine wave) and a current waveform supplied to an electrifying roller respectively.
Figure 18B:
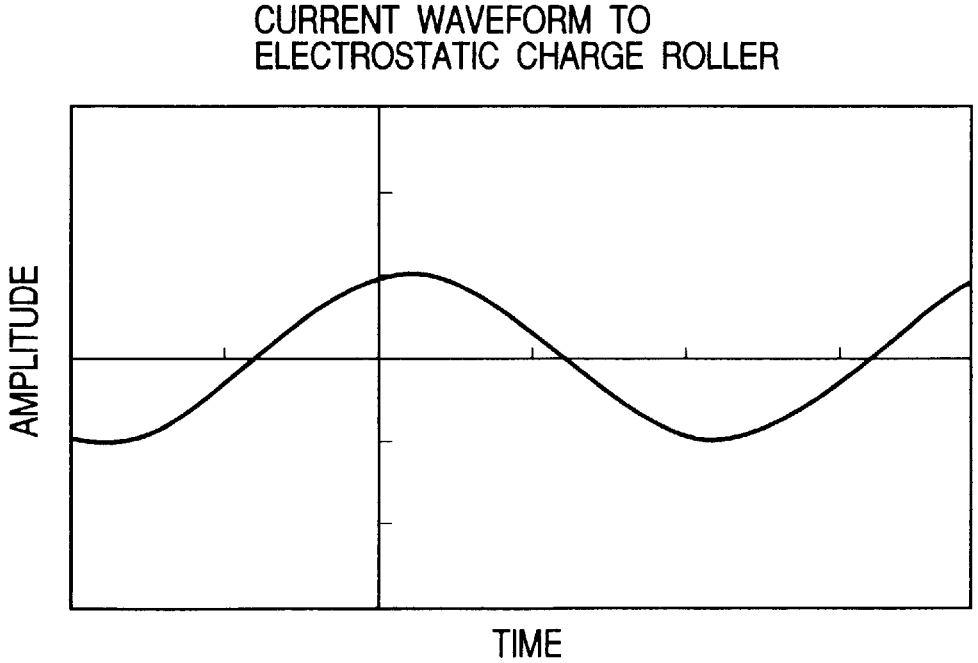

Vth is 1000 V in the configuration of the tenth embodiment. Therefore, applied to the electrifying roller 2 is a bias voltage which consists of an AC voltage having a sine wave at a frequency of 1000 Hz and a peak to peak voltage of 700 V not higher than Vth and a DC voltage of −500 V overlapped with the AC voltage as shown in FIG. 18A. A current waveform supplied to the electrifying roller 2 at this time is shown in FIG. 18B. It will be understood that the current waveform is in a phase shifted from that of a voltage waveform.

Figure 19A:
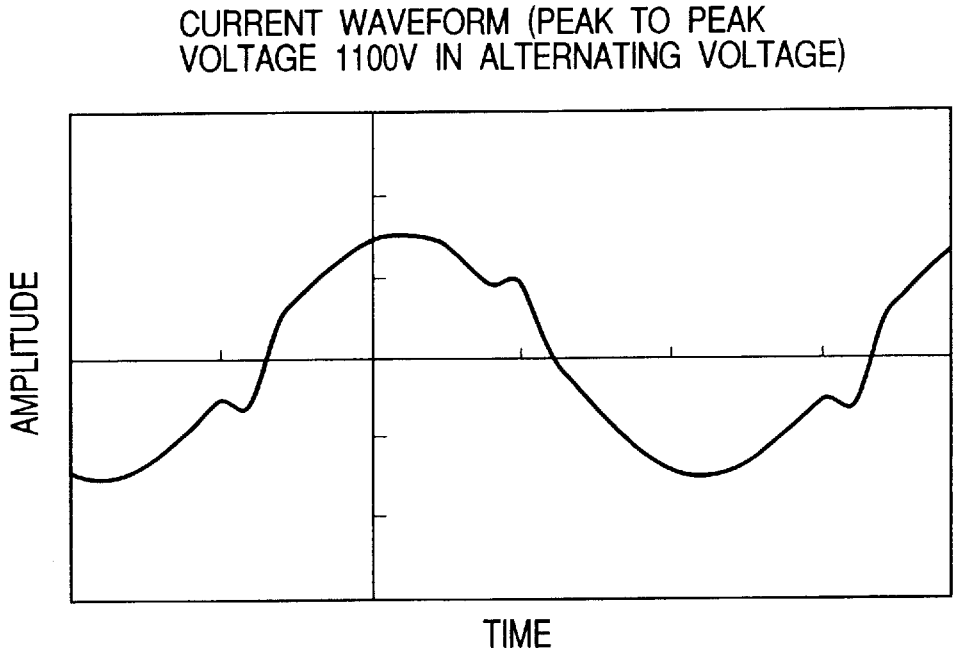
FIGS. 19A and 19B are diagrams showing a current waveform (in case of an alternating voltage having a peak to peak voltage of 1100 V) and a current waveform (in case of an alternating voltage having a peak to peak voltage of 1800 V) respectively.
Figure 19B:
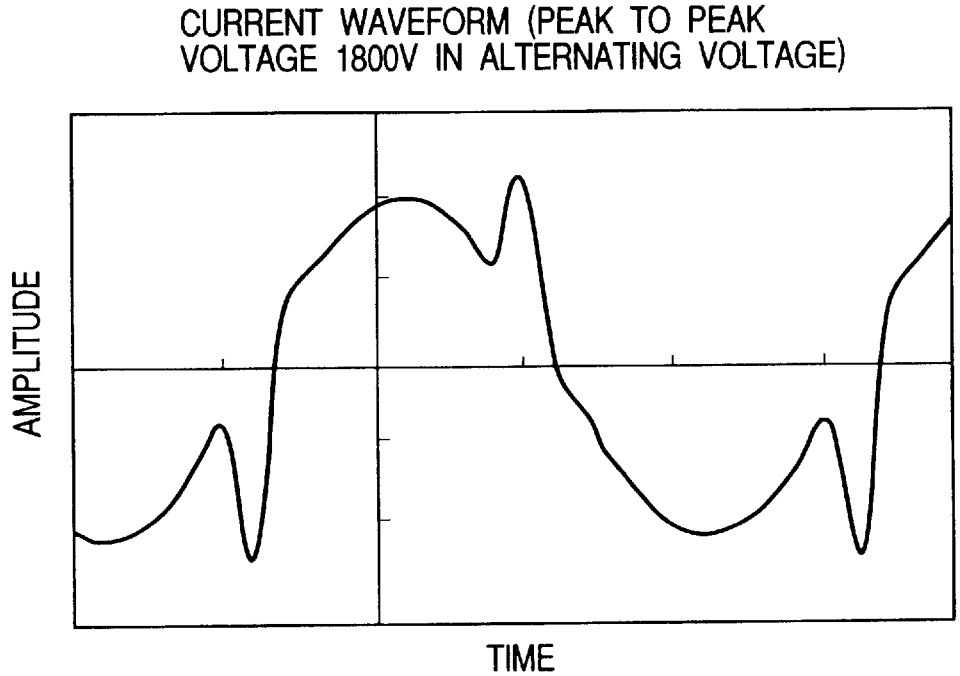

On the other hand, FIG. 19A shows a similar current waveform which is obtained when a peak to peak voltage is set at 1100 V which is slightly higher than Vth. FIG. 19A allows to confirm that the current waveform has a current waveform corresponding to a discharge current in a phase in the vicinity of a peak value of a voltage waveform. FIG. 19B shows a similar current waveform obtained when a peak to peak voltage is further enhanced to 1800 V. It will be understood that a current waveform corresponding to a discharge current is further enhanced.

Accordingly, it will be understood that a current waveform corresponding to a discharge current cannot be captured at a peak to peak voltage which is in the vicinity of a discharge start voltage as described above when a peak to peak value of a current waveform is controlled to constant with a peak hold circuit.

In a cleanerless system such as the tenth embodiment which does not use a cleaning device for recovering the toner remaining on the photosensitive drum 1 and recovers the residual toner with the developing apparatus 4 or the like, resistance of the surface of the photosensitive drum is lowered, resolution of a latent image is lowered and renovating effect by a cleaning device cannot be expected, whereby discharge products produce adverse influences such as image blur and image flow.

It is therefore desired to control a current value with a high accuracy and minimize production of the discharge products. Since a current waveform appears as described above, it is remarkably difficult to detect slight changes of a current waveform due to increase and decrease of a discharge current when a peak hold circuit is used.

It is possible to detect and control a current value more accurately by controlling a voltage to be applied to the electrifying roller with the integral circuit used in the tenth embodiment so that an integral value is constant in a unit time as described above.

Figure 20:
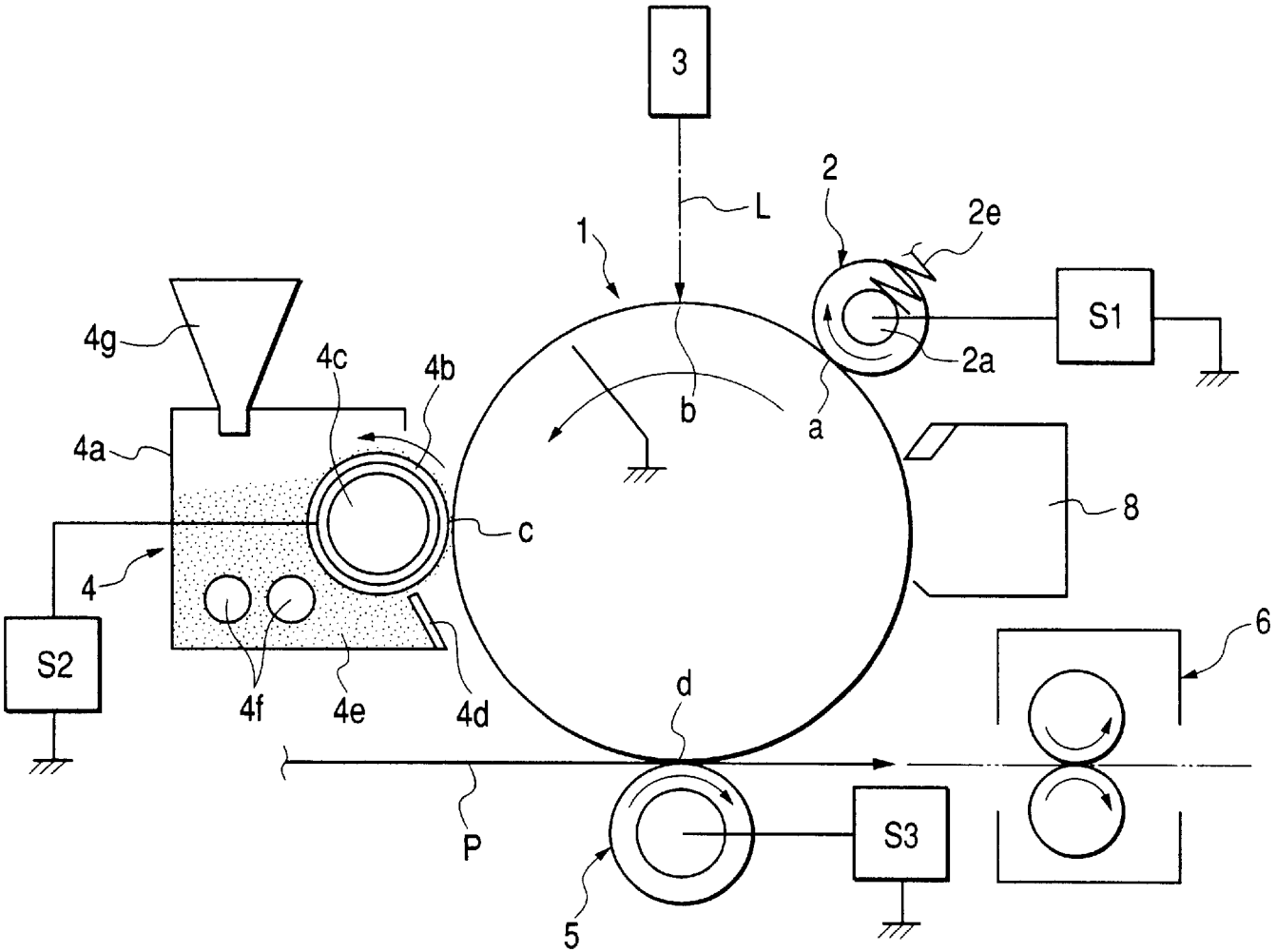
FIG. 20 is a schematic configurational diagram showing an image forming apparatus (with a cleaner) according to another embodiment.

Though the image forming apparatus configured as the cleanerless system has been described in the tenth embodiment, an image forming apparatus which uses a cleaning apparatus 8 as shown in FIG. 20 allows an electric capacity to be changed due to deterioration of a photosensitive drum such as the cutting of the photosensitive drum 1, thereby changing the current supplied to the electrifying roller 2. That is, the image forming apparatus changes a current waveform and improper electrification and image flow since a constant current control method using a peak hold circuit cannot provide stable amount of discharge current dependently on conditions of the photosensitive drum or the like. By using an integral circuit to control so that an integral value of a current waveform is constant, it is possible to detect and control a current value with a high accuracy, thereby improving the image forming apparatus.

<Eleventh embodiment>

The apparatuses shown in FIGS. 14 and 15 are used as an apparatus configuration.

Description will be made of a current waveform supplied to the electrifying roller 2 in a configuration of an eleventh embodiment.

It is known, as disclosed by Japanese Patent Application Laid-Open No. 63-149668, that Vd+Vth (a discharge start voltage) is necessary to obtain a desired potential Vd on a surface of a photosensitive body when a DC voltage is applied to an electrifying roller and in case of a voltage overlapped with an AC voltage component, a DC voltage corresponding to the desired potential and a peak to peak voltage twice or more as high are necessary.

Figure 21A:
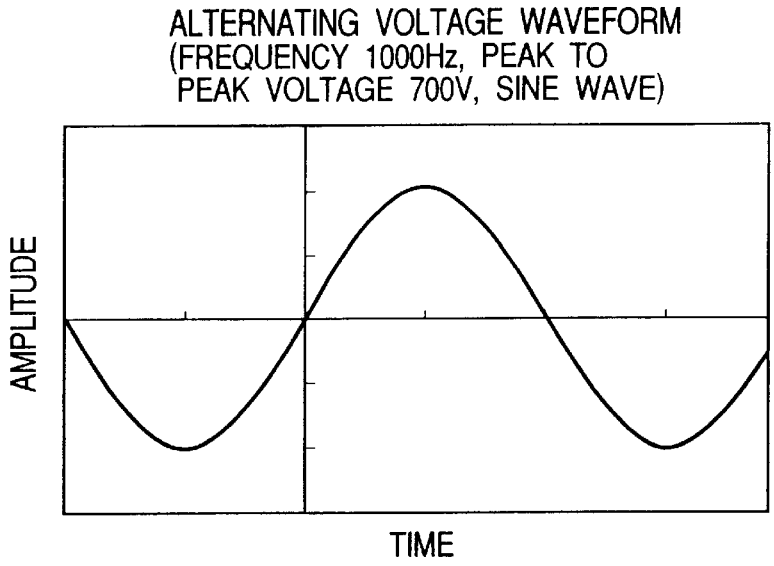
FIGS. 21A, 21B and 21C are diagrams showing an alternating voltage waveform (frequency 1000 Hz, peak to peak voltage 700 V, sine wave), a current waveform supplied to an electrifying roller and a current waveform (in case of an alternating voltage having a peak to peak voltage of 1100 V)
Figure 21B:
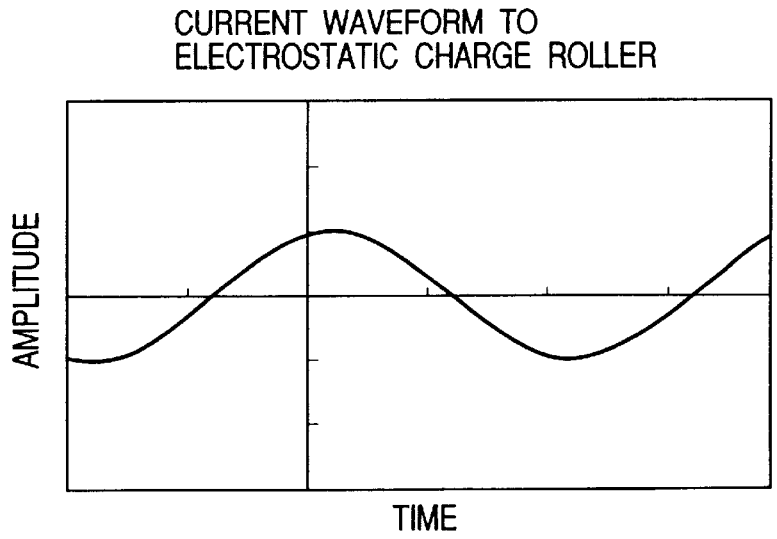

Vth is 1000 V in the configuration of the eleventh embodiment. Applied to the electrifying roller 2 is therefore a bias voltage which consists of an AV voltage having a sine wave at a frequency of 1000 Hz and a peak to peak voltage of 700 V and a DC voltage of −500 V as shown in FIG. 21A. A current waveform supplied to the electrifying roller 2 at this time is shown in FIG. 21B. It will be understood that the current waveform is in a phase which is shifted from that of a voltage waveform.

Figure 21C:
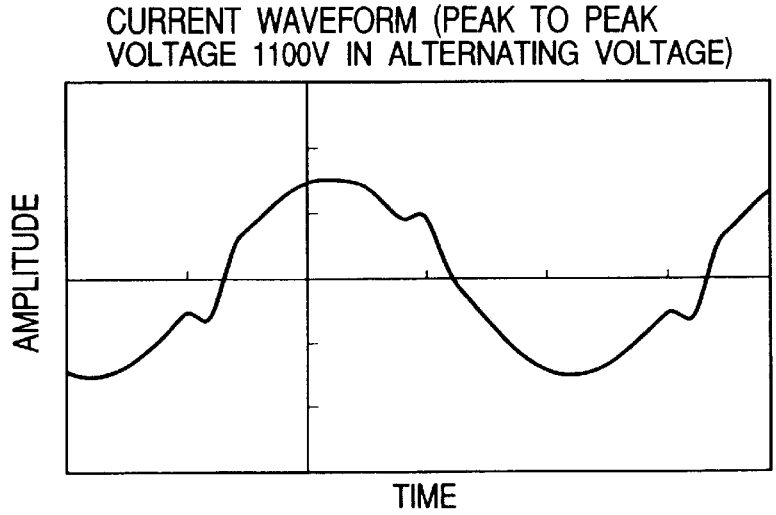

On the other hand, FIG. 21C shows a similar current waveform which is obtained at a peak to peak voltage of 1100 V slightly higher than Vth. FIG. 21C allows to confirm the current waveform has a current waveform corresponding to a discharge current in a phase in the vicinity of a peak value of a voltage waveform.

Figure 22:
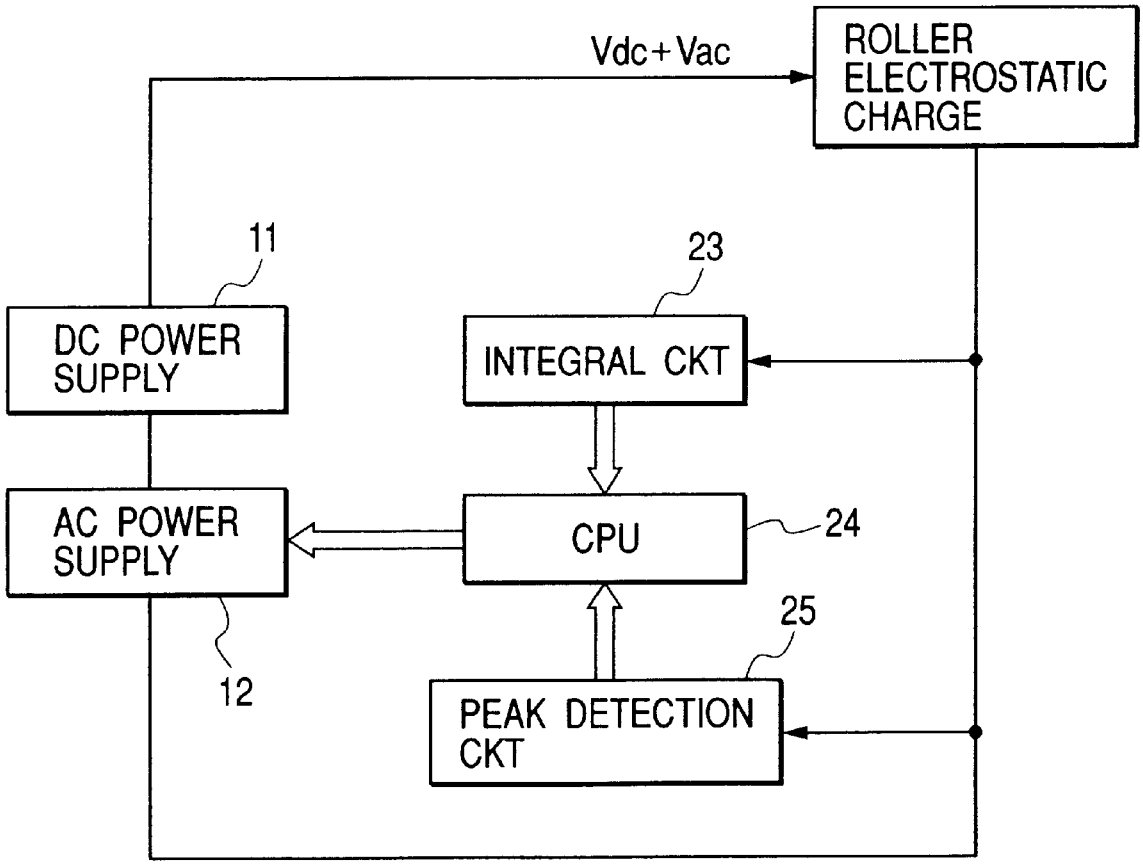
FIG. 22 is a circuit block diagram of a power supply apparatus.

Then, description will be made of a control manner at the electrifying process. FIG. 22 is a block diagram of a power supply circuit for applying a voltage to the electrifying roller 2. Reference numeral 11 denotes a DC power supply, reference numeral 12 denotes an AC power supply and an oscillating voltage Vdc+Vac which consists of a DC voltage Vdc output from the DC power supply 11 and an AC voltage Vac output from the AC power supply 12 and overlapped with the DC voltage Vdc is applied to the electrifying roller 2. Reference numeral 23 denotes an integral circuit which functions as an integral value detecting device for measuring an integral value of a current waveform supplied to the electrifying roller 2. Reference numeral 25 denotes a peak vale detecting circuit as peak value detecting means which measures a peak value of the current waveform. Reference numeral 24 denotes a CPU which functions as a control circuit.

In this power supply circuit, the AC power supply 11 generates an AC voltage having a sine wave at a frequency of 1000 Hz, and an AC voltage component at this time, that is, a peak to peak voltage is subjected to feedback control to change a peak to peak voltage Vpp so that a difference between a value obtained by statistic processing of a value obtained from the integral circuit 23, that is, an integral value of the current waveform in a unit time (a period or half a period) and a value obtained by statistic processing of a value obtained from the peak value detecting circuit 25, that is, an integral value of a current waveform of a discharge current other than the current waveform in the unit time (a period or half a period), that is, an amount of discharge current in the unit time, is maintained at a predetermined definite value.

Description will made here of a method for the feedback control.

First, description will be made of a method to integrate the current waveform with the integral circuit 13. In a case where an AC current waveform is a sine wave as shown in FIG. 17A, integration for a period gives zero when signs of amplitude values are included. Therefore, the current waveform is once converted into a waveform having absolute amplitude values using an absolute value circuit as shown in FIG. 17B and absolute values of the amplitude values are integrated. Alternately, a waveform for half a period may be integrated.

Then, description will be made of a method for the statistic processing of the value obtained from the peak value detecting circuit 25. At an AC voltage having a voltage waveform such as a sine wave which has peak values only at two points for a period as shown in FIG. 21A, a peak value of a current waveform supplied to a stationary load which does not cause discharge or the like is proportional to an AC current. It is therefore possible to determine a current waveform other than a current waveform of a discharge current from a detected peak value and a waveform of an applied voltage.

Figure 23A:
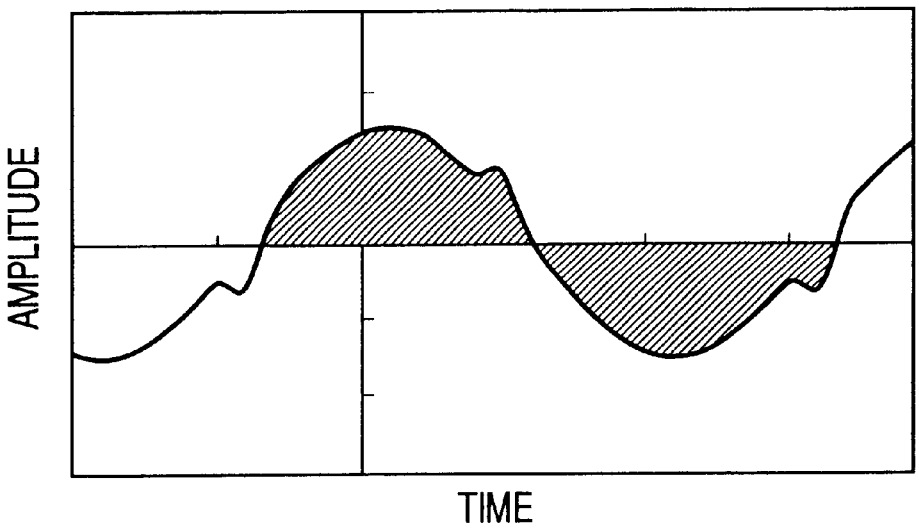
FIGS. 23A and 23B are diagrams descriptive of integration ranges of current waveforms.

As shown in FIG. 21C, at a current waveform on which a discharge current is produced, the integral circuit 13 is capable of determining a value within a range shown in FIG. 23A, that is, an integral value of the current waveform as a whole.

Figure 23B:
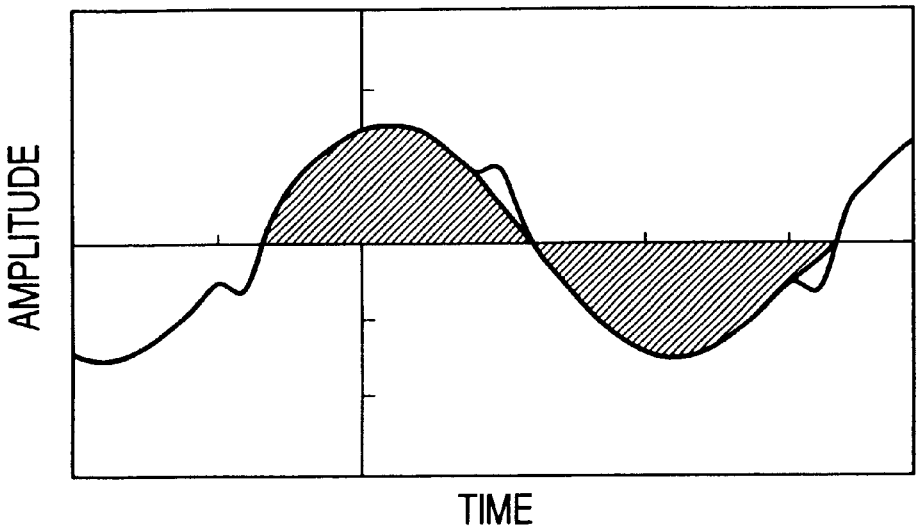

Furthermore, a waveform shown in FIG. 23B can be determined from the peak value detected by the peak value detecting circuit 25 and a waveform of am applied voltage.

Accordingly, it is possible to obtain an amount of discharge current from a difference between integral values determined from both the waveforms. The feedback control is performed so that the amount of discharge current has a desired value.

In the so-called cleanerless system such as the eleventh embodiment which has no cleaning device for recovering the residual toner on the photosensitive drum 1 and recovers the residual toner with the developing apparatus 4 or the like, resistance of the surface of the photosensitive drum is lowered, resolution of a latent image is lowered and a renovating effect of the cleaning device cannot be expected, whereby discharge products produce adverse influences such as image blur and image flow.

It is therefore desired to control a current value with a higher precision, thereby minimizing production of discharge products. Since a current waveform appears as described above, it is possible to solve these problems by controlling slight changes of a current waveform due to increase and decrease of the amount of discharge current by a method such as that described above.

Though description has been made of the image forming apparatus configured as the cleanerless system in the eleventh embodiment, the image forming apparatus which uses the cleaning device 8 as shown in FIG. 20 also allows an electric capacity to be changed due to deterioration of a photosensitive drum such as the cutting of the photosensitive drum 1, thereby changing a current to be supplied to the electrifying roller 2. In other words, the constant current control method which uses a peak hold circuit is incapable of obtaining a stable amount of discharge current dependently on conditions of the photosensitive drum or the like, thereby causing improper electrification and image flow. These problems can be solved by controlling a current by a method such as that described above.

(3) Others

While the present invention has been described with respect to what is presently considered to be the preferred embodiments, the present invention is not limited to the disclosed embodiments. Rather, the present invention covers various modifications and equivalent arrangements included within the spirit and scope of the appended claims.

1) An electrifying member may not always be in contact with a surface of a body to be electrified, but may be disposed contactlessly in the vicinity with a void (gap), for example of tens of micrometers, so far as a discharge permitting area determined by a gap to gap voltage and correcting Paschen curve is securely warranted between the electrifying member and the body to be electrified (proximity electrification). The present invention includes this case also within a category of the contact electrification.

2) An image bearing body may be a direct injection charged type which has a charge injection layer having a surface resistance of $10^9$ to $10^{14}$ Ωcm. An equivalent effect can be obtained, for example, with an image bearing body which does not use a charge injection layer but uses a charge transporting layer having resistance within the above described range. An amorphous silicon photosensitive body which has a surface layer having volume resistance of approximately $10^{13}$ Ωcm is preferably usable.

3) In addition to the electrifying roller, usable as a flexible contact electrifying member is a member having a different form or made of a different material such as a fur brush, felt member or a cloth member. Furthermore, it is possible to obtain a contact electrifying member which has more appropriate elasticity, electrical conductivity, surface property and durability by combining various kinds of materials.

4) A sine wave, a rectangular wave, a triangular wave or the like are appropriately usable as a waveform of an alternating voltage component (an AC component or a voltage having a periodically changing voltage value) of an oscillating electric field to be applied to the contact electrifying member and the developing member. The alternating voltage component may have a rectangular waveform prepared by periodically turning on and off a DC power supply.

5) The image exposure device provided as the device for writing information on the electrified surface of the photosensitive body used as the image bearing body may be, for example, a digital exposure device using a solid light emitting element array such as LEDs other than the laser scanning device used in the embodiments. The information write device may also be an analog image exposure device which uses a halogen lamp or a fluorescent lamp as a light source for illuminating an origin. Any device may be used as the information write device so far as the device can form an electrostatic latent image corresponding to image information.

6) The image bearing body may be an electrographic recording dielectric body or the like. In this case, an electrostatic latent image corresponding to target image information is formed by uniformly electrifying a surface of the above described dielectric body and then selectively eliminating charges from the electrified surface using a static eliminator such as a static eliminating needle head or an electron gun.

7) An electrostatic latent image may be developed with a toner by any method or with any device. The reversal development method or the regular development method may be used.

Generally speaking, methods for developing electrostatic latent images are roughly classified into four kinds: a method (single-component contactless development) which develops an electrostatic latent image by coating a non-magnetic toner on a developer bearing conveying member such as a sleeve using a blade or the like or coating a magnetic toner over a developer bearing conveying member with a magnetic force, conveying and applying the toner to an image bearing body in a contactless condition, a method (single-component contact development) which develops an electrostatic latent image by applying a toner which is coated over a developer bearing conveying member to an image bearing body in a contact condition, a method (two-component contact development) which develops an electrostatic latent image by using a mixture of toner particles and a magnetic carrier as a developer (two-component developer), conveying and applying the developer with a magnetic force to an image bearing body in a contact condition, and a method (two-component contactless development) which develops an electrostatic latent image by applying the above described two-component developer to an image bearing body in a contactless condition.

8) A transferring device is not limited to the transferring roller used in the embodiments and may be a blade transferring device, a belt transferring device, another contact transferring electrifying device or a contactless transferring electrifying device using a corona electrifier.

9) The present invention is applicable not only to image forming apparatuses which form monochromatic images using intermediate transferring bodies such as transferring drums and transferring belts but also image forming apparatuses which forms multiple color images and full color images by multiple transferring or the like.

What is claimed is:

1. A control method of a voltage to be applied to an electrifier, comprising the steps of:

measuring an integral value of an alternating current waveform; and controlling an alternating voltage so that the integral value is constant in a predetermined time, wherein the integral value is a value to which absolute values of the alternating current waveform are integrated.

2. A control method of a voltage to be applied to an electrifier, comprising the steps of:

measuring an integral value of an alternating waveform;

detecting a peak value of the alternating waveform;

calculating an area of the alternating waveform from a detected peak value; and controlling an alternating voltage so that a difference between the integral value and the area becomes constant.

3. The control method of a voltage to be applied to an electrifier according to claim 2, wherein the alternating waveform is a current waveform.

4. The control method of a voltage to be applied to an electrifier according to claim 3, wherein the integrated value is a value to which absolute values of the alternating current waveform are integrated.

5. A control method of a voltage to be applied to an electrifier, comprising the steps of:

applying an alternating voltage having a peak to peak voltage lower than twice a discharge start voltage to the electrifier and measuring a first alternating current value supplied when the alternating voltage having a peak to peak voltage lower than twice a discharge start voltage is applied;

applying an alternating voltage having a peak to peak voltage not lower than twice the discharge start voltage to the electrifier and measuring a second alternating current value supplied when the alternating voltage having a peak to peak voltage not lower than twice the discharge start voltage is applied; and determining a peak to peak voltage of an alternating voltage to be applied to said electrifier at an electrifying time on the basis of the first and second alternating current values.

6. The control method of a voltage to be applied to an electrifier according to claim 5, wherein a third alternating current value which is supplied at the time of applying an alternating voltage having the determined peak to peak voltage is measured and a peak to peak voltage of an alternating voltage to be applied at a next electrifying time is corrected on the basis of the third alternating current value.

7. The control method of a voltage to be applied to an electrifier according to claim 5, wherein the first and second alternating current values are measured while an image is not formed.

8. The control method of a voltage to be applied to an electrifier according to claim 5, wherein the second alternating current value which is supplied at the time of applying an alternating voltage having a peak to peak voltage not lower than twice a discharge start voltage to the electrifier is measured at a plurality of points.

9. The control method of a voltage to be applied to an electrifier according to claim 5, wherein constant voltage control is performed at the decided peak to peak voltage value while an image is formed.

10. The control method of a voltage to be applied to an electrifier according to claim 9, wherein a peak to peak voltage-alternating current function fI1 (Vpp) which is obtained by connecting the first alternating current value supplied when a peak to peak voltage lower than twice a dischargement start voltage is applied to the electrifier to 0 is compared with a peak to peak voltage-alternating current function fI2 (Vpp) which is obtained from the second alternating current value supplied when a peak to peak voltage not lower than at least twice the discharge start voltage, thereby determining a peak to peak voltage satisfying a condition:

$$fI2(Vpp)-fI1(Vpp)=D$$

wherein D denotes a predetermined constant.

11. The control method of a voltage to be applied to an electrifier according to claim 10, wherein the first alternating current value which is supplied at the time of applying the alternating voltage having the peak to peak voltage lower than twice the discharge start voltage is measured at a point and the second alternating voltage value which is supplied at the time of applying the alternating voltage having the peak to peak voltage not lower than twice the discharge start voltage is measured at two points.

12. The control method of a voltage to be applied to an electrifier according to claim 10, wherein the first alternating current value is supplied when the alternating voltage having the peak to peak voltage lower than twice the discharge start voltage is measured at a plurality of points and the second alternating current value is supplied when the alternating voltage having the peak to peak voltage not lower than twice the discharge start voltage is measured at a plurality of points.

13. The control method of a voltage to be applied to an electrifier according to claim 5, wherein an environment is detected and a peak to peak voltage is determined on the basis of a detected environment and a measured alternating current value.

14. A method of controlling a current to be supplied to an electrifier comprising the steps of:

supplying an alternating current for generating a peak to peak voltage lower than twice a discharge start voltage to the elctrifier and measuring a first peak to peak voltage of the alternating voltage applied to the electrifier when the alternating current for generating a peak to peak voltage lower than twice a discharge start voltage is supplied;

supplying an alternating current for generating a peak to peak voltage not lower than twice the discharge start voltage to the electrifier and measuring a second peak to peak voltage of the alternating voltage applied to the electrifier when alternating current for generating a peak to peak voltage not lower than twice the discharge start voltage is supplied; and determining an alternating current to be supplied to the electrifier at a electrifying time on the basis of the first peak to peak voltage and the second peak to peak voltage.

15. A method according to claim 14, wherein the peak to peak voltage of the alternating voltage applied to the electrifier is measured when the determined alternating current is supplied to the electrifier, and the alternating current to be supplied to the electrifier at a next electrifying time is corrected on the basis of the measured value.

16. A method according to claim 14, wherein the first and second peak to peak voltages are measured while an image is not formed.

17. A method according to claim 14, wherein the second peak to peak voltage is measured for a plurality of values of the alternating current for generating the peak to peak voltage lower than twice the discharge start voltage.

18. A method according to claim 14, wherein constant current control is performed to the electrifier at the determined alternating current while an image is formed.

19. A method according to claim 18, wherein a peak to peak voltage-alternating current function fI1 (Vpp) which is obtained from the first peak to peak voltage when the alternating current for generating the peak to peak voltage lower than twice the discharge start voltage is supplied to the electrifier is compared with a peak to peak voltage-alternating current function fI2 (Vpp) which is obtained from the second peak to peak voltage when at least two alternating currents for generating the peak to peak voltage not lower than twice the discharge start voltage are supplied, thereby determining a alternating current satisfying a condition:

$$fI2(Vpp)=fI1(Vpp)+D$$

wherein D denotes a predetermined constant.

20. A method according to claim 19, wherein the first peak to peak voltage is measured for a plurality of values of the alternating current for generating the peak to peak voltage not lower than twice the discharge start voltage.

21. A method according to claim 14, wherein an environment is detected and the alternating current to be supplied to the electrifier at the electrifying time is determined on the basis of the detected environment.

* * * * *

UNITED STATES PATENT AND TRADEMARK OFFICE

CERTIFICATE OF CORRECTION

PATENT NO. : 6,532,347 B2
DATED : March 11, 2003
INVENTOR(S) : Watanabe et al.

It is certified that error appears in the above-identified patent and that said Letters Patent is hereby corrected as shown below:

Column 1,
Line 13, “convential” should read -- conventional --.

Column 6,
Line 3, “tone-!r” should read -- toner --.

Column 9,
Line 15, “formula 1” should read -- Formula 1 --; and
Line 44, “mity.” should read -- mity.
In order to always obtain a desired amount of discharge current, the inventors therefore carried out control via the procedures described below. --.

Column 34,
Lines 44-49, should be deleted.

Column 36,
Line 4, “like.” should read -- like.
While the present invention has been described with respect to what are presently considered to be the preferred embodiments, the present invention covers various modifications and equivalent arrangements included within the spirit and scope of the appended claims. The scope of the appended claims is to be accorded the broadest interpretation so as to encompass all such modifications and equivalent structures and functions. --.

Column 37,
Line 10, “dischargement” should read -- discharge --.

Signed and Sealed this

Second Day of March, 2004

JON W. DUDAS
*Acting Director of the United States Patent and Trademark Office*